US008958722B2

(12) United States Patent
Oda et al.

(10) Patent No.: US 8,958,722 B2
(45) Date of Patent: Feb. 17, 2015

(54) EXTRACTOR FOR EXTRACTING A DISPERSOID AND A DISPERSION MEDIUM AND IMAGING FORMING APPARATUS EMPLOYING THIS EXTRACTOR

(75) Inventors: Tomoyuki Oda, Osaka (JP); Tomohisa Soda, Osaka (JP); Hiroyuki Ueda, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 937 days.

(21) Appl. No.: 12/908,941

(22) Filed: Oct. 21, 2010

(65) Prior Publication Data

US 2011/0103840 A1 May 5, 2011

(30) Foreign Application Priority Data

Oct. 28, 2009 (JP) ..... 2009-248082
Oct. 28, 2009 (JP) ..... 2009-248083
Oct. 28, 2009 (JP) ..... 2009-248084

(51) Int. Cl.
*G03G 15/10* (2006.01)

(52) U.S. Cl.
CPC ..... *G03G 15/104* (2013.01)
USPC ..... 399/240

(58) Field of Classification Search
USPC ..... 399/240, 237, 238, 239, 241, 248
See application file for complete search history.

(56) References Cited

U.S. PATENT DOCUMENTS 5,923,930 A 7/1999 Tsukamoto et al.
2004/0197116 A1* 10/2004 Yoshino et al. ..... 399/237
2008/0298843 A1* 12/2008 Hobo et al. ..... 399/238

FOREIGN PATENT DOCUMENTS

JP 2003-270957 9/2003
JP 2005-173031 6/2005
JP 2008-102319 5/2008
JP 2008-299065 12/2008

* cited by examiner

*Primary Examiner* — Billy Lactaoen
(74) *Attorney, Agent, or Firm* — Gerald E. Hespos; Michael J. Porco; Matthew T. Hespos

(57) ABSTRACT

An extractor separates a dispersoid (toner) and a dispersion medium (carrier liquid) from a liquid sample (liquid developer) containing the dispersoid and the dispersion medium and extracts these. The extractor has a first roller that carries a thin layer of the liquid sample containing the dispersoid and the dispersion medium on a circumferential surface thereof and rotates about a shaft. A separating member is in contact with the first roller and separates the dispersion medium from the thin layer carried on the first roller. A charger charges the dispersoid in the thin layer carried on the first roller at a position upstream of a contact position of the separating member with the first roller with respect to a rotating direction of the first roller. An electric field generator generates an electric field for causing the charged dispersoid to be attracted to the circumferential surface of the first roller.

11 Claims, 17 Drawing Sheets

FIG. 6

| THIN LAYER CHARGE AMOUNT (V) | | | | |
|---|---|---|---|---|
| < | ≧ | | | |
| 500 | 450 | | | |
| 450 | 400 | | | |
| 400 | 350 | | | |
| 350 | 300 | | | |
| 300 | 250 | | | |
| 250 | 200 | | | |
| 200 | 150 | | | |
| 150 | 100 | | | ○ |
| 100 | 90 | | | |
| 90 | 80 | | | |
| 80 | 70 | | | |
| 70 | 60 | | | |
| 60 | 50 | ○ | | |
| 50 | 40 | ○ | ○ | |
| 40 | 30 | ○ | ○ | |
| 30 | 20 | ○ | ○ | |
| 20 | 10 | ○ | | |
| 10 | 0 | | | |
| TONER SOLID CONTENT DENSITY | | 5% | 15% | 30% |
| CHARGER APPLYING VOLTAGE | | 4KV | 5KV | 6KV |

| | | COLLECTED LIQUID DEVELOPER TONER SOLID CONTENT DENSITY (%) | | | | | | | | |
|---|---|---|---|---|---|---|---|---|---|---|
| | | 30 | | | 15 | | | 5 | | |
| COROTRON CHARGE BIAS (kV) | | 4 | 5 | 6 | 4 | 5 | 6 | 4 | 5 | 6 |
| TONER COLLECTING ROLLER BIAS (V) | 200 | × | × | × | × | × | × | × | × | × |
| | 300 | × | × | × | × | ○ | ○ | ○ | ○ | ○ |
| | 400 | × | × | × | × | ○ | ○ | ○ | ○ | ○ |

○: TONER SOLID CONTENT DENSITY IN EXTRACTED CARRIER LIQUID ≦ 0.1%

EXTRACTOR FOR EXTRACTING A DISPERSOID AND A DISPERSION MEDIUM AND IMAGING FORMING APPARATUS EMPLOYING THIS EXTRACTOR

BACKGROUND OF THE INVENTION

1. Field of the Invention

The present invention relates to an extractor for separating and extracting a dispersoid and a dispersion medium from a liquid sample containing the dispersoid and the dispersion medium, and an image forming apparatus employing this extractor.

2. Description of the Related Art

A technology for performing a specified process using a liquid carried on a circumferential surface of, e.g. a roller is utilized in many fields such as a printing technology. For example, such a technology is applied to a wet-type image forming apparatus using a liquid developer (e.g. copier, printer, facsimile machine or a complex machine with functions of these).

A liquid used for a process contains a dispersoid and a dispersion medium in many cases. A liquid developer containing a toner as a dispersoid and a carrier liquid as a dispersion medium is used, for example, in the above image forming apparatus. The dispersion medium takes a role in promoting uniform dispersion of the dispersoid to enable a uniform and/or stable process. In a specific process, it is desired to collect and reutilize the dispersion medium.

There is known an image forming apparatus provided with a recycling device for collecting a dispersion medium. The recycling device is so structured that a conductive roller is arranged at an inner side of a conductive pipe while defining a small clearance to the conductive pipe and a liquid developer is poured into the clearance. By forming an electric field between the conductive pipe and the conductive roller, the toner and the carrier liquid are separated and the carrier liquid is collected thereafter.

However, in the above recycling device, it takes much time to separate the toner and the carrier liquid and the recycling device cannot be installed in a wet-type image forming apparatus designed to perform a high-speed printing process. If the clearance between the conductive pipe and the conductive roller could be reduced to a level of several microns, the toner and the carrier liquid could be separated at a higher speed. However, in view of part accuracy and device construction, it is substantially impossible to cause the conductive pipe and the conductive roller to face each other with a clearance in the order of several microns therebetween.

SUMMARY OF THE INVENTION

In view of the above situation, an object of the present invention is to provide an extractor capable of separating a dispersoid and a dispersion medium at a high speed and an image forming apparatus employing such an extractor.

In order to accomplish this object, one aspect of the present invention is directed to an extractor for separating and extracting a dispersoid and a dispersion medium from a liquid sample containing the dispersoid and the dispersion medium, including a first roller which carries a thin layer of the liquid developer containing the dispersoid and the dispersion medium on a circumferential surface thereof and rotates about a shaft; a separating member held in contact with the first roller and adapted to separate the dispersion medium from the thin layer carried on the first roller; a charger for charging the dispersoid in the thin layer carried on the first roller at a position upstream of a contact position of the separating member with the first roller with respect to a rotating direction of the first roller; and an electric field generator for generating an electric field for causing the charged dispersoid to be attracted to the circumferential surface of the first roller.

Another aspect of the present invention is directed to a wet-type image forming apparatus, including an image forming unit for forming an image using a liquid developer containing a toner and a carrier liquid; and an extractor for separating and extracting the toner and the carrier liquid from the liquid developer, wherein the extractor has the above construction.

Still another aspect of the present invention is directed to an image forming apparatus, including a photoconductive drum for bearing a toner image on a circumferential surface thereof; a developing unit for supplying a liquid developer containing a toner and a carrier liquid to the photoconductive drum; a developer producing unit for producing a liquid developer having a blending ratio of the toner and the carrier liquid adjusted; a first supply system for supplying a developer having a higher toner density than the one used in the developing unit to the developer producing unit; a second supply system for supplying the carrier liquid to the developer producing unit; a third supply system for supplying the liquid developer produced in the developer producing unit to the developing unit via a reserve tank; a collection system for collecting the liquid developer supplied to the developing unit, but not consumed by the developing unit or the photoconductive drum and supplying it to the developer producing unit; and an extractor provided in the collection system for separating and extracting the toner and the carrier liquid from the collected liquid developer, wherein the extractor has the above construction.

Other objects of the present invention and specific advantages obtained by the present invention will become more apparent from the description of embodiments below.

BRIEF DESCRIPTION OF THE DRAWINGS

FIG. 6 is a table showing a charge amount control table in the extractor of the second embodiment.

DETAILED DESCRIPTION OF THE PREFERRED EMBODIMENTS

First Embodiment

Figure 1:
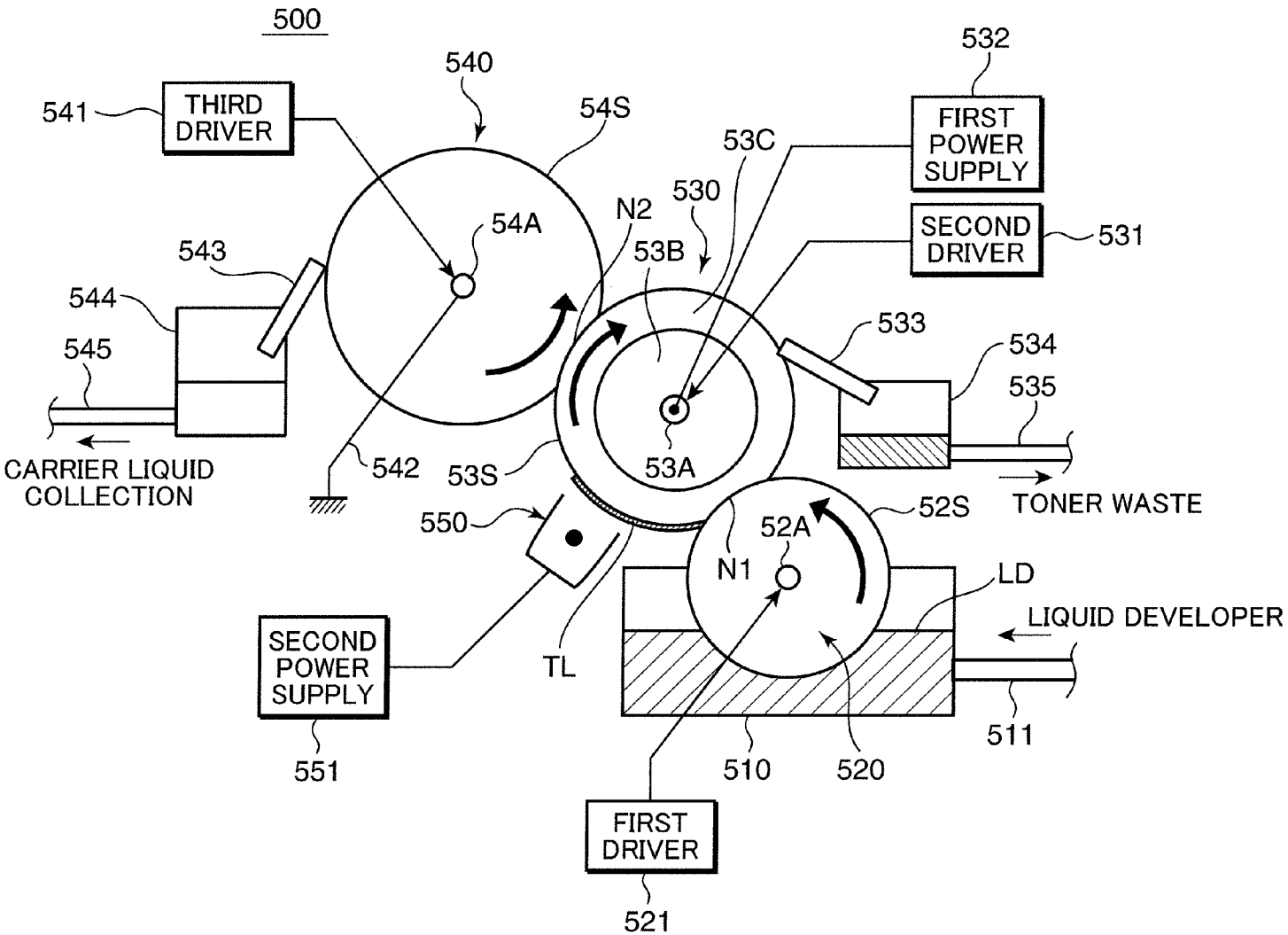
FIG. 1 is a diagram showing a construction of a carrier liquid extractor according to a first embodiment of the invention.

Hereinafter, embodiments of the present invention are described in detail with reference to the drawings. FIG. 1 is a diagram showing a construction of a carrier liquid extractor 500 (extractor) according to a first embodiment of the present invention. This carrier liquid extractor 500 is a device applied to a wet-type image forming apparatus using a liquid developer (liquid sample) and adapted to separate a toner solid content (hereinafter, referred to merely as "toner" or "toner particles") as a dispersoid and a carrier liquid as a dispersion medium from the liquid developer used for image formation and collect the carrier liquid for reutilization. The carrier liquid extractor 500 includes a liquid tank 510, a measuring roller 520 (third roller), a toner collecting roller 530 (first roller), a carrier liquid collecting roller 540 (separating member; second roller) and a charger 550.

The liquid tank 510 is a box with an open upper side, and a liquid developer LD is stored in this tank. A developer supply pipe 511 is connected to the liquid tank 510, and the liquid developer LD collected in an image forming unit is successively supplied into the liquid tank 510 via the developer supply pipe 511 by driving an unillustrated pump. An agitating member for agitating the liquid developer LD is desirably provided in this liquid tank 510.

The measuring roller 520 is a roller composed of a cylindrical body made of a metal having good lyophilicity to the liquid developer LD and rotates in a counterclockwise direction about its rotary shaft 52A. In this embodiment, a roller which is made of stainless steel and whose circumferential surface 52S has a surface roughness with a maximum height Ry of 6.3 in JIS roughness shape parameter (JIS B0601-1994) is used as the measuring roller 520. The measuring roller 520 is so mounted in the liquid tank 510 that a lower part thereof is immersed in the liquid developer LD stored in the liquid tank 510 and an upper part thereof projects upward through an opening of the liquid tank 510. Thus, the circumferential surface 52S of the measuring roller 520 is constantly partly in contact with the liquid developer LD with an appropriate amount of the liquid developer LD stored in the liquid tank 510.

The measuring roller 520 is driven and rotated by a first driver 521. The first driver 521 includes a motor for generating a rotation drive force and a gear mechanism for transmitting the rotation drive force to the rotary shaft 52A of the measuring roller 520. When the measuring roller 520 is rotated, the circumferential surface 52S immersed in the liquid developer LD moves upward and the liquid developer LD is attached to this circumferential surface 52S by a surface tension. Accordingly, when the measuring roller 520 rotates, a predetermined amount of the liquid developer LD is drawn up and conveyed along the circumferential surface 52S form the liquid tank 510 according to wettability of the circumferential surface 52S to the liquid developer LD.

The toner collecting roller 530 is a roller which carries a thin layer TL of the liquid developer on its circumferential surface 53S and rotates in a clockwise direction about its rotary shaft 53A. In this embodiment, a roller structured such that an outer layer 53C made of conductive rubber is disposed on a conductive metal core 53B is used as the toner collecting roller 530. The conductive rubber is urethane having a JIS-A hardness of 30 and a volume resistivity of 105 Ω·cm. A fluororesin coating layer is applied to the outer surface of this urethane layer 53C to promote mold releasability of the toner.

By pressing the circumferential surface 52S of the measuring roller 520 into contact with the circumferential surface 53S of the toner collecting roller 530, the two rollers 520, 530 form a first nip portion N1. The charger 550 to be described later is arranged to face an outer peripheral part of the toner collecting roller 530. The first nip portion N1 is formed at a position upstream of the arranged position of the charger 550 with respect to a rotating direction of the toner collecting roller 530.

The toner collecting roller 530 is driven and rotated by a second driver 531. The second driver 531 includes a motor for generating a rotation drive force and a gear mechanism for transmitting the rotation drive force to the rotary shaft 53A of the toner collecting roller 530. A voltage is applied from a first power supply 532 (electric field generator) to the rotary shaft 53A. The rotary shaft 53A, the metal core 53B and the outer layer 53C are in a conductive state, and the circumferential surface 53A of the toner collecting roller 530 is charged through the application of the voltage from the first power supply 532 to the rotary shaft 53A. In this embodiment, the first power supply 532 applies a voltage of −400 V to the rotary shaft 53A to charge the circumferential surface 53S to a negative potential.

A first blade 533 for scraping off the toner attached to the circumferential surface 53S of the toner collecting roller 530 is arranged at a position downstream of a second nip portion N2 between the toner collecting roller 530 and the carrier liquid collecting roller 540 to be described later with respect to the rotating direction of the toner collecting roller 530. The tip of the first blade 533 is in contact with the circumferential surface 53S in a direction opposite to the rotating direction of the toner collecting roller 530. The toner collected by the first blade 533 is collected into a toner collection container 534 and introduced to an unillustrated toner waste container through a toner waste conduit 535.

The carrier liquid collecting roller 540 is a roller which is pressed into contact with the toner collecting roller 530 to form the second nip portion N2, separates the carrier liquid from the thin layer TL of the liquid developer carried on the circumferential surface 53S of the toner collecting roller 530 and carries the separated carrier liquid on its circumferential surface 54S. In this embodiment, a stainless steel roller having good wettability to the carrier liquid is used as the carrier liquid collecting roller 540.

The carrier liquid collecting roller 540 is driven and rotated in a counterclockwise direction about its rotary shaft 54A by a third driver 541. The third driver 541 includes a motor for generating a rotation drive force and a gear mechanism for transmitting the rotation drive force to the rotary shaft 54A of the carrier liquid collecting roller 540. The rotary shaft 54A is electrically connected to a ground path 542, whereby the carrier liquid collecting roller 540 has a ground potential. Thus, between the carrier liquid collecting roller 540 and the toner collecting roller 530 is generated such an electric field as to set the circumferential surface 54S of the former roller to a zero potential and the circumferential surface 53S of the latter roller to −400 V.

A second blade 543 for scraping off the carrier liquid carried on the circumferential surface 54S of the carrier liquid collecting roller 540 is arranged at a position downstream of the second nip portion N2 with respect to the rotating direction of the carrier liquid collecting roller 540. The tip of the second blade 543 is in contact with the circumferential surface 54S in a direction opposite to the rotating direction of the carrier liquid collecting roller 540. The carrier liquid collected by the second blade 543 is collected into a carrier liquid collection container 544 and introduced to a device for reutilization of the carrier liquid (e.g. carrier tank 274 shown in FIG. 18) through a carrier liquid collecting conduit 545.

The charger 550 applies a voltage to the thin layer TL of the liquid developer carried on the toner collecting roller 530 to charge the toner of the thin layer TL. The charger 550 is a corotron charger provided with a charging wire and arranged to face the circumferential surface 53S of the toner collecting roller 530 at a side upstream of the second nip portion N2 (downstream of the first nip portion N1) with respect to the rotating direction of the toner collecting roller 530. Note that the charger 550 may be a scorotron charger or roller charger.

A charging voltage is given from a second power supply 551 to the charger 550. In this embodiment, the second power supply 551 supplies a positive potential of +4 kV to the charging wire. Thus, the toner in the thin layer TL is charged in a range of about +10 V to +60 V. Since the circumferential surface of the toner collecting roller 530 is charged to a negative potential of −400 V as described above, the positively charged toner is electrically attracted to the circumferential surface 53S of the toner collecting roller 530. Here, if the charged voltage of the toner is equal to or below +10V, there is a tendency that no sufficient electrical attraction force to the circumferential surface 53S can be ensured. On the other hand, if the charged voltage exceeds +60 V, there is a tendency that an attraction force of the toner to the circumferential surface 53S becomes too strong and it becomes difficult to scrape off the toner from the circumferential surface 53S by the first blade 533.

Next, the operation of the carrier liquid extractor 500 is described with reference to FIGS. 2 and 3A to 3C in addition to FIG. 1. When the carrier liquid extractor 500 is operated, the measuring roller 520, the toner collecting roller 530 and the carrier liquid collecting roller 540 are respectively driven and rotated in the counterclockwise direction, clockwise direction and counterclockwise direction. Rotational circumferential speeds of the respective rollers can be, for example, set such that the rotational circumferential speed of the measuring roller 520 is 1330 mm/s, that of the toner collecting roller 530 is 1200 mm/s and that of the carrier liquid collecting roller 540 is 1200 mm/s.

The liquid developer LD in the liquid tank 510 is attached to the circumferential surface 52S by a surface tension, drawn up and conveyed to the first nip portion N1 by the rotation of the measuring roller 520. The thin layer TL of the liquid developer LD comes to be carried on the circumferential surface 53S of the toner collecting roller 530 by the passage of the drawn-up liquid developer LD through the first nip portion N1. Here, the thin layer TL is desirably a layer having a uniform thickness of 4 to 9 microns, particularly about 6 to 7 microns.

Figures 3A, 3B, 3C:
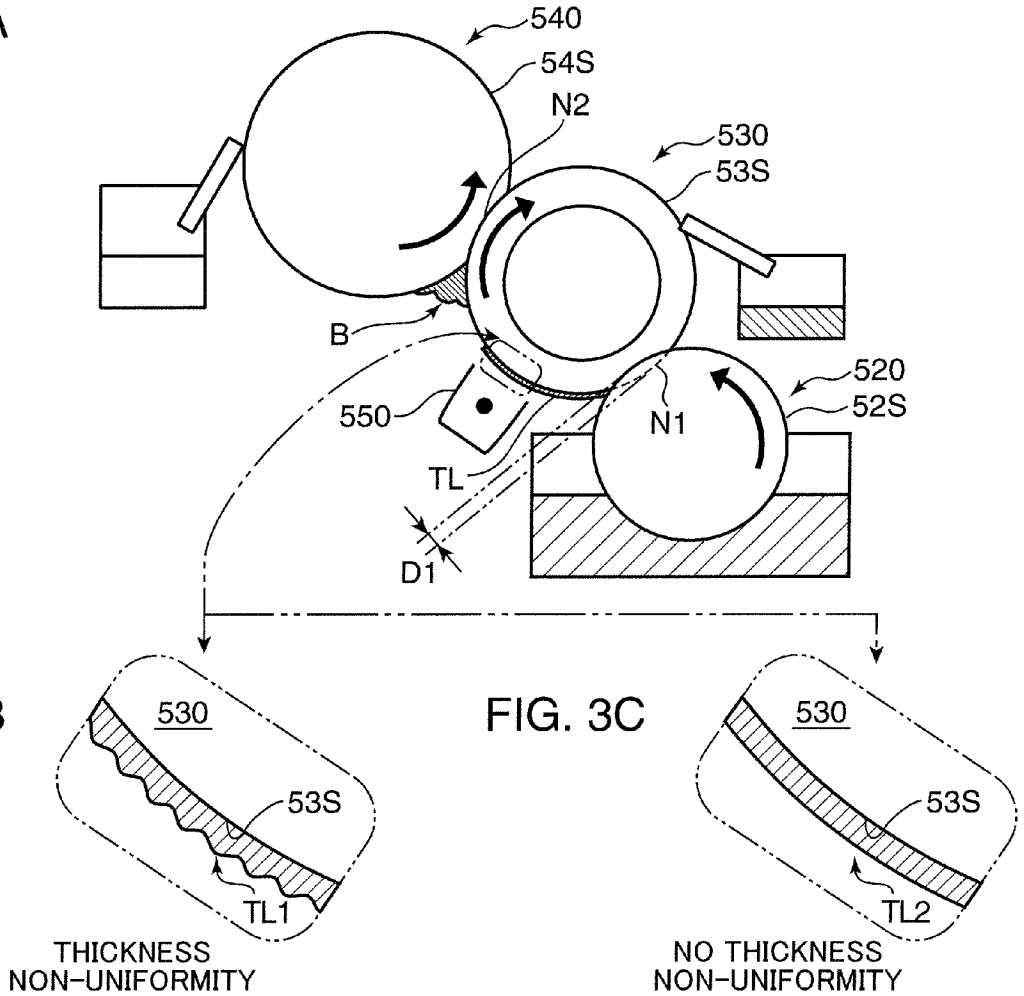
FIGS. 3A to 3C are diagrams showing an operation of the carrier liquid extractor.

A nip depth D1 of the first nip portion N1 shown in FIG. 3A and a difference between the rotational circumferential speeds of the measuring roller 520 and the toner collecting roller 530 have a relatively larger effect on the formation of the above desirable thin layer TL than other factors. The nip depth D1 for forming the thin layer TL having a thickness of about 6 to 7 microns is, for example, 0.1 mm. Further, in order to form not a thin layer TL1 with thickness non-uniformity as shown in FIG. 3B, but a thin layer TL2 with substantially no thickness non-uniformity as shown in FIG. 3C, it is desirable to set a ratio of the rotational circumferential speed of the measuring roller 520 to that of the toner collecting roller 530 rotating in the opposite direction to about 1:0.9 and rotate the measuring roller 520 relatively faster. The above rotational circumferential speeds of the two rollers are set based on this ratio and the first and second drivers 521, 531 (first driving device) drive and rotate the measuring roller 520 and the toner collecting roller 530 according to such setting.

The excessively thick thin layer TL and the thin layer TL1 with thickness non-uniformity as shown in FIG. 3B could hinder optimal toner charging by the charger 550. Such a thin layer TL or TL1 could also cause a trouble that a part thereof cannot pass the second nip portion N2. If this trouble occurs, a liquid buildup B is formed at a position immediately upstream of the second nip portion N2 as shown in FIG. 3A. If the liquid buildup B grows, it gradually drops, thereby raising a problem of contaminating the surrounding.

The thin layer TL formed on the circumferential surface 53S of the toner collecting roller 530 is conveyed to the arranged position of the charger 550 by the clockwise rotation of the toner collecting roller 530. As described above, the charger 550 receives the supply of electric energy from the second power supply 551 and applies the voltage of +4 kV to the thin layer TL present on the circumferential surface 53S of the toner collecting roller 530 as described above. On the other hand, the voltage of −400 V is applied to the rotary shaft 53A of the toner collecting roller 530 by the first power supply 532 to charge the circumferential surface 53S to a negative potential.

Figure 2:
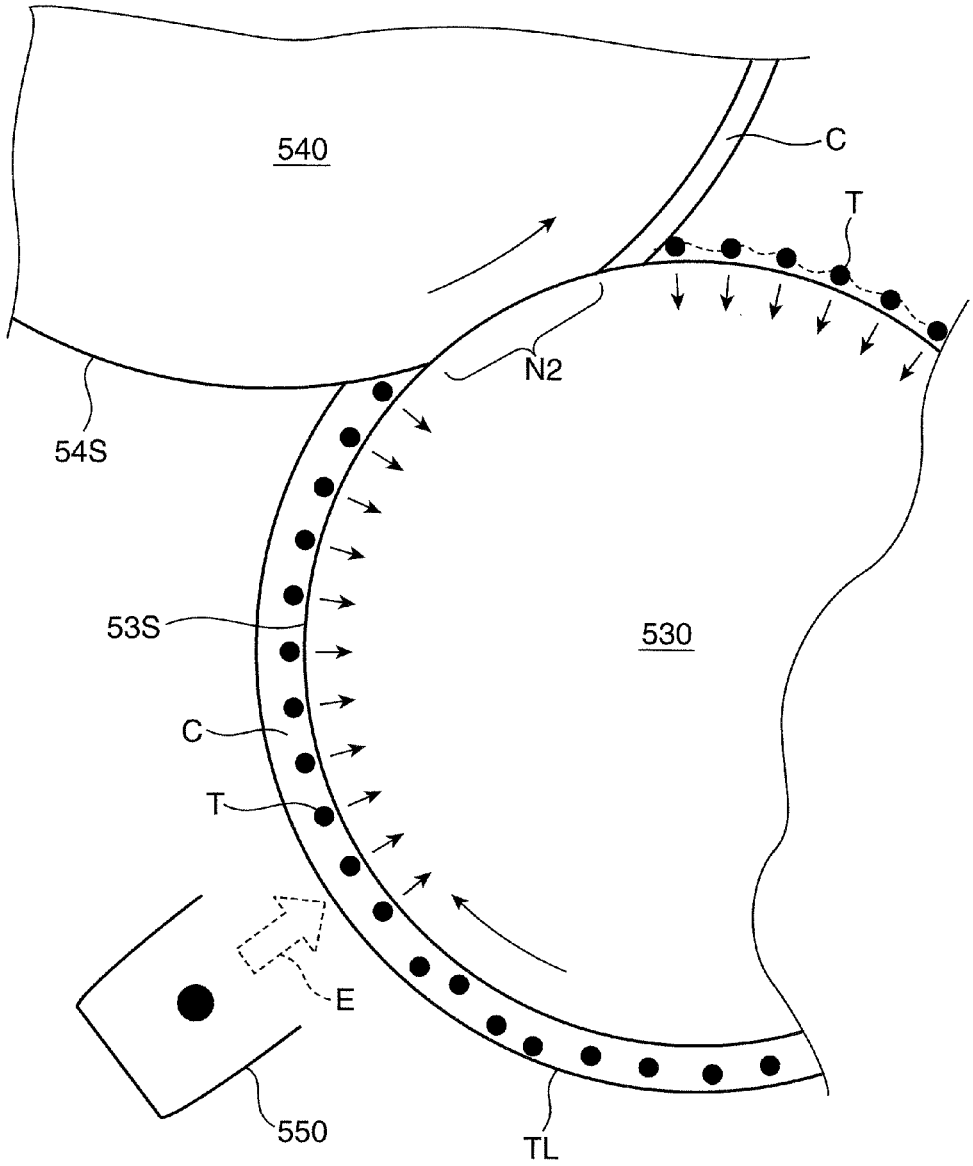
FIG. 2 is a diagram showing a function of a charger in the carrier liquid extractor.

With reference to FIG. 2, toner particles T are irregularly floating in the thin layer TL before passing the charger 550. On the other hand, when the thin layer TL passes the arranged position of the charger 550, the toner particles T in the thin layer TL are charged to a positive potential (about +10 V to +60 V) since a voltage E is applied from the charger 550 to the thin layer TL. As a result, in the thin layer TL having passed the charger 550, the toner particles T are electrically strongly attracted to the circumferential surface 53S of the toner collecting roller 530 charged to the negative potential. Thus, there is formed a layer structure in which the toner particles T are located immediately on the circumferential surface 53S and the carrier liquid C is located on the outer peripheries of the toner particles T.

Thereafter, the thin layer TL heads for the second nip portion N2. Since the carrier liquid collecting roller 540 is set at the ground potential as described above, the toner particles T pass the second nip portion N2 while being electrically attracted to the circumferential surface 53S of the toner collecting roller 530 without being transferred to the circumferential surface 54S of the carrier liquid collecting roller 540. On the other hand, since the circumferential surface 54S has good wettability to the carrier liquid C, the carrier liquid C comes to adhere to the circumferential surface 54S. As a result, after passing the second nip portion N2, the toner particles T are conveyed along the circumferential surface 53S of the toner collecting roller 530 and the carrier liquid C is conveyed along the circumferential surface 54S of the carrier liquid collecting roller 540.

The toner particles T on the circumferential surface 53S are scraped off by the first blade 533 (FIG. 1) and collected into the toner collection container 534. The toner particles T and the carrier liquid C are not completely separated at the second nip portion N2 and the material collected into the toner collection container 534 contains a small amount of the carrier liquid C. The carrier liquid C on the circumferential surface 54S is scraped off by the second blade 543 (FIG. 1) and collected into the carrier liquid collection container 544.

According to the carrier liquid extractor 500 of the first embodiment described above, the thin layer TL of the liquid developer LD is carried on the circumferential surface 53S of the toner collecting roller 530 and the toner particles T in this thin layer TL are electrically attracted to the circumferential surface 53S since the thin layer TL is charged by the charger 550. Thus, the toner particles T can be eccentrically present immediately on the circumferential surface 53S of the toner collecting roller 530 in the thin layer TL and the carrier liquid C can be easily separated by the carrier liquid collecting roller 540. Therefore, the toner particles T and the carrier liquid C can be separated at a high speed.

Figure 4:
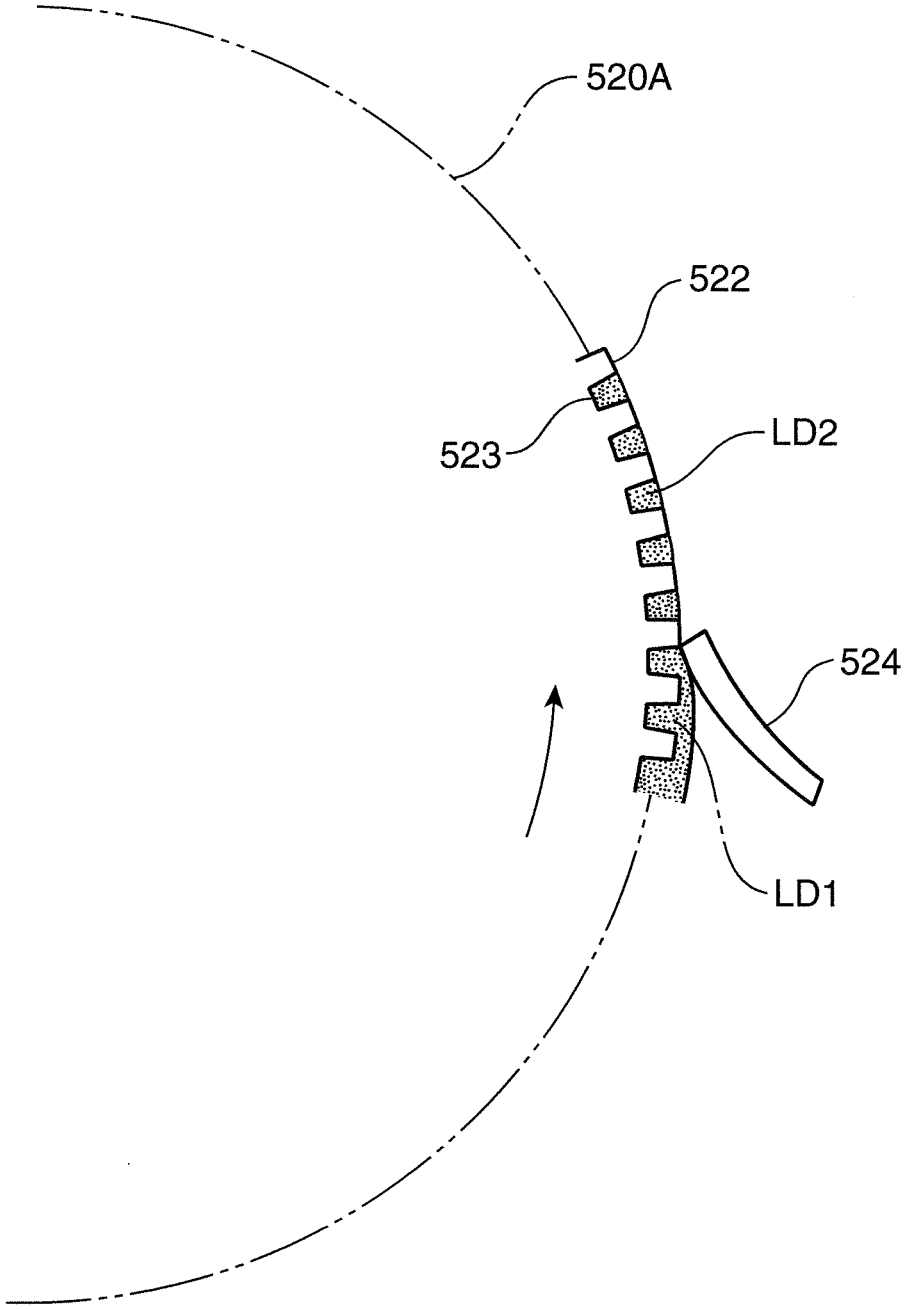
FIG. 4 is a diagram showing another example of a measuring roller.

Here, a modification of the measuring roller 520 is illustrated. FIG. 4 is a view diagrammatically showing a measuring roller 520A according to this modification. This measuring roller 520A is an anilox roller including projections 522 and recesses 523. A doctor blade 524 (measuring member) is held in contact with the circumferential surface of the measuring roller 520A. The doctor blade 524 is for restricting an amount of the liquid developer to be held on the circumferential surface of the measuring roller 520A, so that only a liquid developer LD2 is carried in the recesses 523 out of a liquid developer LD1 irregularly adhering to the circumferential surface of the measuring roller 520A. According to such a measuring roller 520A, the amount of the liquid developer LD drawn up from the liquid tank 510 can be accurately controlled according to the volume of the recesses 523.

Second Embodiment

Figure 5:
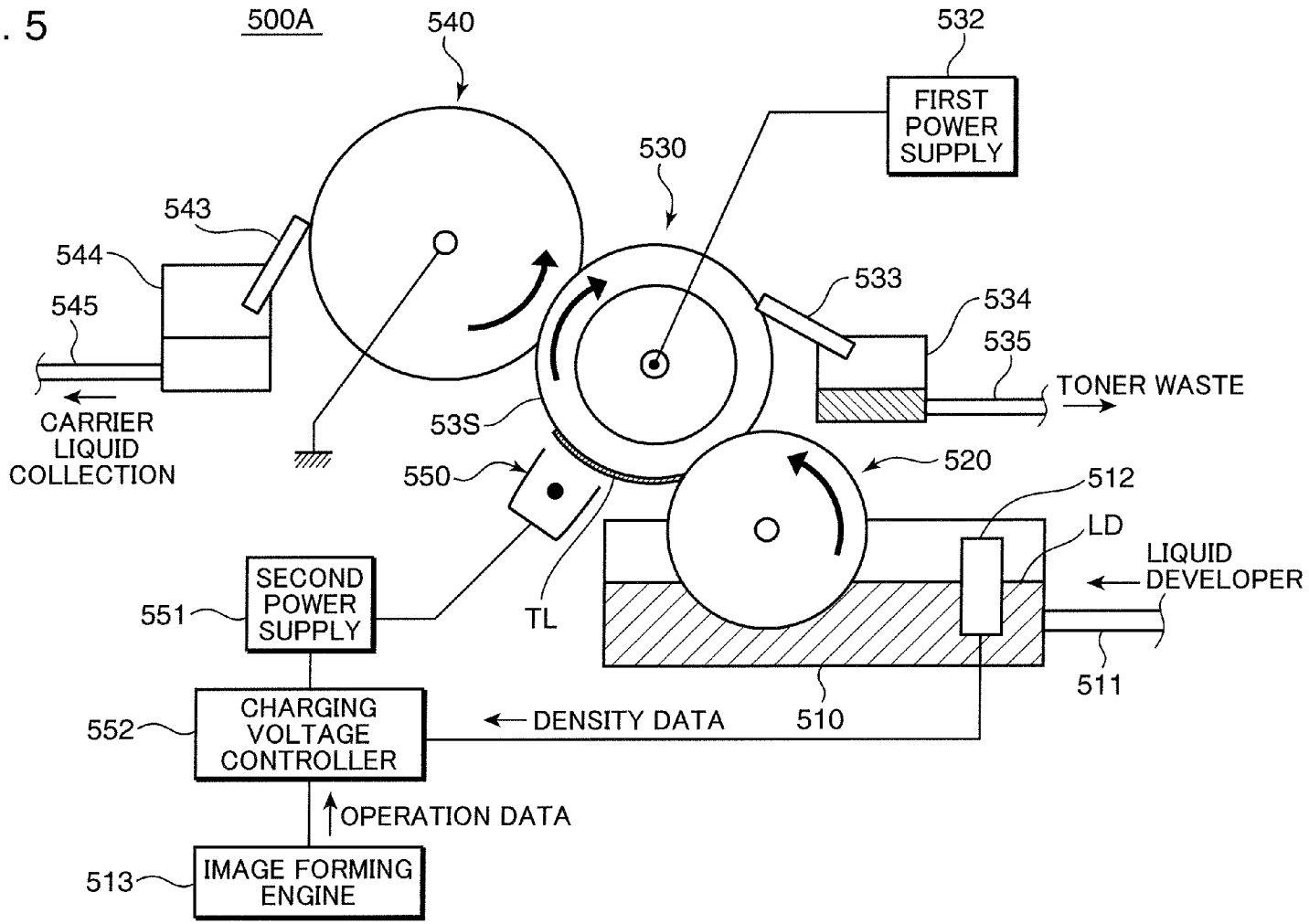
FIG. 5 is a diagram showing a construction of a carrier liquid extractor according to a second embodiment of the invention.

FIG. 5 is a diagram showing a construction of a carrier liquid extractor 500A according to a second embodiment. In FIG. 5, the same parts as in the carrier liquid extractor 500 of the first embodiment are denoted by the same reference numerals and these parts are not described or are only briefly described. Some constructions little involved in the second embodiment are not shown.

The carrier liquid extractor 500A is the same as the carrier liquid extractor 500 of the first embodiment in including the liquid tank 510, the measuring roller 520, the toner collecting roller 530, the carrier liquid collecting roller 540 and the charger 550. The carrier liquid extractor 500A differs from the carrier liquid extractor 500 in further including a toner density sensor 512 (density detector) for detecting a toner density in the liquid developer LD stored in the liquid tank 510 and a charging voltage controller 552 (first charge adjusting device/second charge adjusting device and density estimator) for controlling the second power supply 551 for supplying a voltage to the charger 550 according to the toner density.

The toner density sensor 512 is, for example, a light transmissive sensor utilizing a change in a light transmission amount depending on the density of toner particles in the liquid developer LD. The toner density sensor 512 is arranged in the liquid tank 510, and a sensor probe thereof is arranged at such a position as to be able to contact with the liquid developer LD. An output data of the toner density sensor 512 according to the density of the toner particles is given as a toner density data to the charging voltage controller 552.

The charging voltage controller 552 adjusts a charge amount of the toner in the thin layer TL by controlling an output voltage of the second power supply 551 according to the toner density data given from the toner density sensor 512. In a simplest adjustment, the charging voltage controller 552 sets the output voltage of the second power supply 551 at a predetermined first voltage in order to charge the toner with a predetermined first charge amount when the toner density sensor 512 detects that the toner density in the liquid developer LD is a normal density (first density). When the toner density is detected to be a density (second density) higher than the normal density by a predetermined value or more, the charging voltage controller 552 sets the output voltage of the second power supply 551 at a second voltage higher than the first voltage by a predetermined value in order to charge the toner with a second charge amount higher than the first charge amount by a predetermined amount.

The toner density in the liquid developer collected from a wet-type image forming unit is, for example, about 5%. With the liquid developer having such a toner density, a thin layer TL having a thickness of about 6 to 7 microns can be formed on the circumferential surface 53S of the toner collecting roller 530 by setting the rotational circumferential speeds of the measuring roller 520 and the toner collecting roller 530 and the nip depth D1 of the first nip portion N1 as in the first embodiment. However, the toner density may increase for a certain reason. For example, if a state where a toner image carried on a photoconductive drum is collected without being transferred to a sheet continues due to an occurrence of a paper jam or a solid layer of toner is intentionally attached and collected to and from the photoconductive drum for maintenance or another occasion, the toner density of the collected liquid developer increases. If the toner density increases, for example, to about 30%, the viscosity of the liquid developer increases, with the result that the thin layer TL tends to be thicker with the same rotational circumferential speed and nip depth D1. If the thin layer TL becomes thicker, the toner particles in the thin layer TL become insufficiently charged, thereby making it difficult to realize a clear layer separation of the toner particles T and the carrier liquid C as shown in FIG. 2.

In view of this point, the charging voltage controller 552 executes such a control as to optimize the charge amount of the thin layer TL (toner particles T) by increasing the output voltage of the second power supply 551 as the toner density in the liquid developer LD in the liquid tank 510 increases. Since an electrical attraction force of the toner particles T to the circumferential surface 53S of the toner collecting roller 530 is ensured in this way, the toner particles T and the carrier liquid C can be satisfactorily separated even if the density of a dispersoid increases to thicken the thin layer TL.

FIG. 6 is a table showing an example of a control table for the charge amount of the thin layer TL. In this example, the charge amount is controlled with the toner density divided into three levels. When the toner density is a normal density at a 5%-level (density of 0 to 15%), the charging voltage controller 552 sets the charge amount of the thin layer TL at +10 V to +60 V by setting the voltage to be applied from the second power supply 551 to the charging wire of the charger 550 at +4 kV. This is the same set value as in the first embodiment.

When the toner density is a medium density at a 15%-level (density of 15 to 30%), the charging voltage controller 552 sets the charge amount of the thin layer TL in a range of +20 V to +50 V by increasing the output voltage of the second power supply 551 to +5 kV. By raising a lower limit level of the charge amount according to an increase in the output voltage in this way, electrical attraction of the toner particles T to the circumferential surface 53S can be made reliable. Further, when the toner density is a high density at a 30%-level (density of 30% or higher), the charging voltage controller 552 sets the charge amount of the thin layer TL in a range of +100 V to +150 V by increasing the output voltage of the second power supply 551 to +6 kV. By this, the electrical attraction force of the toner particles T to the circumferential surface 53S is improved and the toner particles T can be reliably attracted to the circumferential surface 53S even if the thin layer TL becomes thicker.

The toner density in the collected liquid developer LD can be estimated from operation records of the image forming apparatus. In view of this point, the charging voltage controller 552 can obtain operation data of this wet-type image forming apparatus from an image forming engine 513, estimate the toner density and control the output voltage of the second power supply 551. In other words, the charge amount control similar to the above can be executed based on the operation data obtained from the image forming engine 513 without actually measuring the toner density using the toner density sensor 512.

The image forming engine 513 includes an unillustrated operation data memory, and operation data including an image dot number data on formed toner images, a jam record, an execution record of a maintenance mode and other data are stored in this memory. The charging voltage controller 552 obtains such operation data and estimates the toner density (third or fourth density) in the collected liquid developer LD from coverage rates or an occurrence frequency of toner images collected without being transferred to sheets although being carried on the photoconductive drum, for example, due to paper jams or other reasons or from an execution frequency of the maintenance mode. Then, the charging voltage controller 552 controls the output voltage of the second power supply 551 in order to control the charge amount (third or fourth charge amount) in accordance with the charge amount control table shown in FIG. 6 based on this estimated density data.

In the second embodiment, the charging voltage controller 552 may utilize both the density data from the toner density sensor 512 and the operation data from the image forming engine 513 or may obtain a toner density value based on either one of the data. For example, a sequence of normally using the density data and using the operation data when the toner density sensor 512 is in trouble is a preferred embodiment.

Third Embodiment

Figure 7:
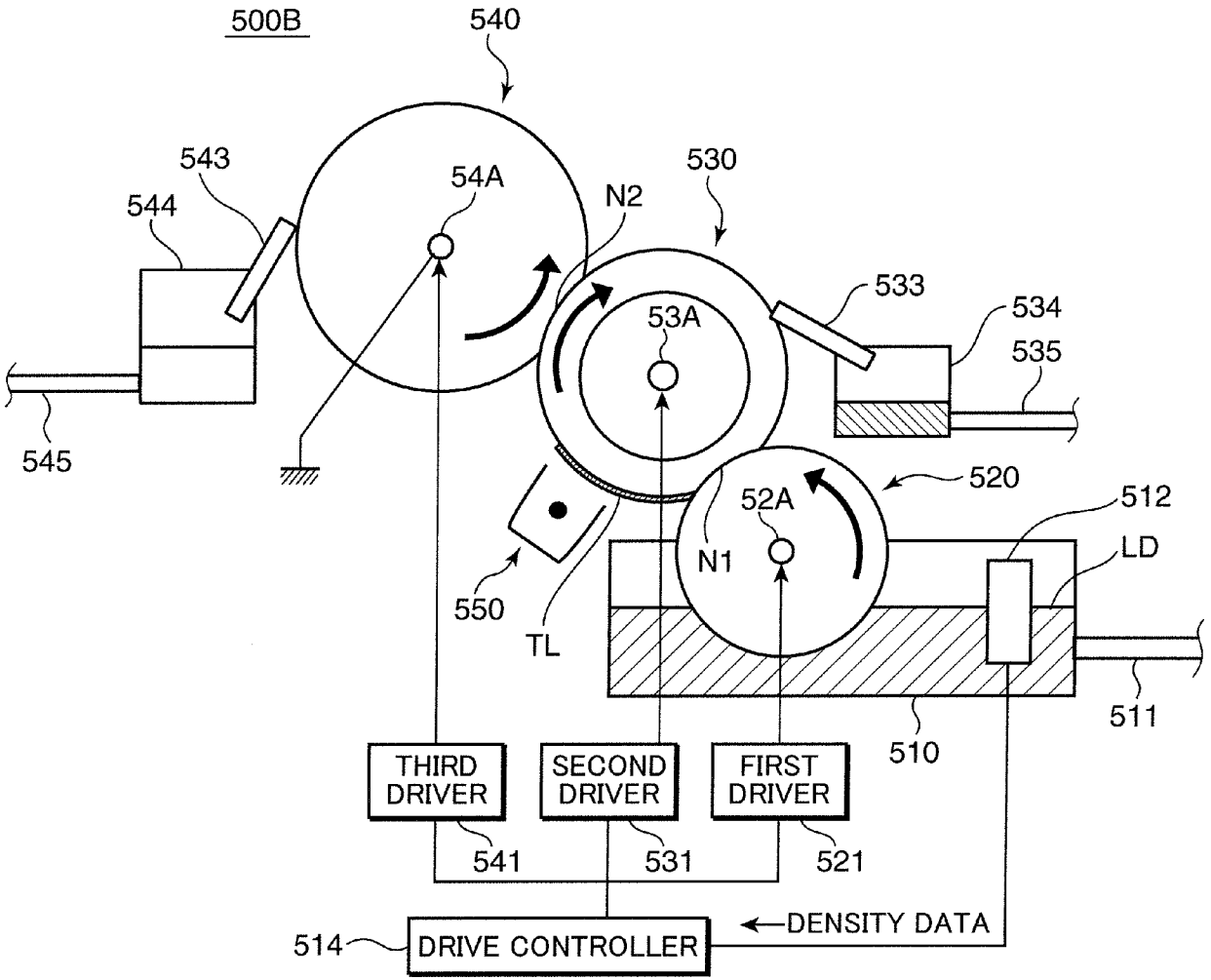
FIG. 7 is a diagram showing a construction of a carrier liquid extractor according to a third embodiment of the invention.

FIG. 7 is a diagram showing a construction of a carrier liquid extractor 500B according to a third embodiment. In FIG. 7, the same parts as in the carrier liquid extractors 500, 500A of the first and second embodiments are denoted by the same reference numerals and these parts are not described or are only briefly described. Further, some constructions little involved in the third embodiment are not shown.

The carrier liquid extractor 500B is the same as the carrier liquid extractor 500 of the first embodiment in including the liquid tank 510, the measuring roller 520, the toner collecting roller 530, the carrier liquid collecting roller 540 and the charger 550 as a basic construction and also including the first, second and third drivers 521, 531 and 541 for driving and rotating the respective rollers 520, 530 and 540. Further, the carrier liquid extractor 500B is the same as the carrier liquid extractor 500A of the second embodiment in including the toner density sensor 512 for detecting the toner density in the liquid developer LD stored in the liquid tank 510. On the other hand, the carrier liquid extractor 500B differs from the previous embodiments in including a drive controller 514 (thickness adjusting device/second driving device/third driving device) for controlling the drive and rotation of the respective rollers 520, 530 and 540 by the first, second and third drivers 521, 531 and 541 to adjust the thickness of the thin layer TL carried on the circumferential surface 53S of the toner collecting roller 530.

In the second embodiment, there is shown the example in which the output voltage of the second power supply 551 to the charger 550 increases as the toner density in the liquid developer LD increases, i.e. as the thin layer TL becomes thicker according to an increase in the viscosity of the liquid developer LD. In this third embodiment, there is shown an example in which the thickness of the thin layer TL is actively adjusted by controlling the rotational circumferential speeds of the respective rollers 520, 530 and 540 based on the toner density.

The drive controller 514 basically executes such a control that the thin layer TL is formed with a normal thickness (first thickness) on the circumferential surface 53S of the toner collecting roller 530 when the toner density sensor 512 detects that the toner density in the liquid developer LD is a normal density (fifth density) while being formed with a thickness (second thickness) smaller than the normal thickness by a predetermined value or more on the circumferential surface 53S when the toner density is detected to be a higher density (sixth density) than the normal density by a predetermined value or more. As specific examples for realizing such a control, here are illustrated (1) reductions in the rotational circumferential speeds of all the rollers 520, 530 and 540 and (2) an increase in the rotational circumferential speed of the measuring roller 520.

(1) Reductions in the Rotational Circumferential Speeds of All the Rollers

Figure 9A:
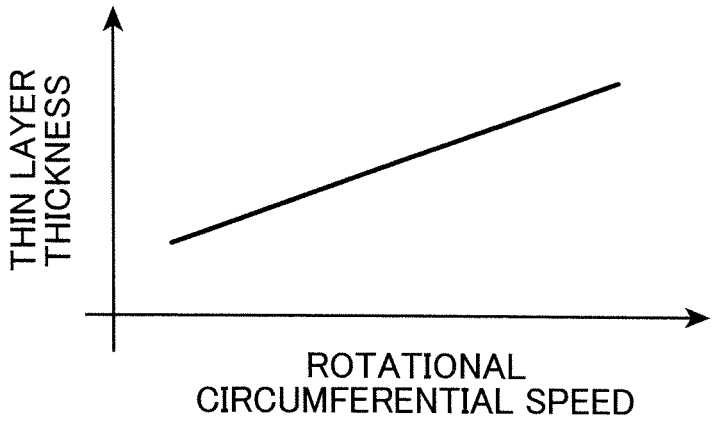
FIGS. 9A to 9C are graphs showing a thickness control for a thin layer of a liquid developer formed on a toner collecting toner.

FIG. 9A is a graph showing a relationship between an overall linear speed of the carrier liquid extractor 500B and the thickness of the thin layer TL formed on the circumferential surface 53S of the toner collecting roller 530. Here, the overall linear speed is determined by the rotational circumferential speeds of the respective rollers 520, 530 and 540. As shown in the graph, the thin layer TL becomes thinner as the rotational circumferential speeds decrease. This is because the amount of the liquid developer LD that can pass the first nip portion N1 decreases as the rotational circumferential speeds of the measuring roller 520 and the toner collecting roller 530 decrease.

The drive controller 514 controls the first, second and third drivers 521, 531 and 541 such that the rotational circumferential speed of the measuring roller 520 is 1330 mm/s, that of the toner collecting roller 530 is 1200 mm/s and that of the carrier liquid collecting roller 540 is 1200 mm/s as in the first embodiment when the toner density sensor 512 detects the toner density to be a normal density (e.g. 5%). Note that a nip depth of the first nip portion N1 is 0.1 mm. At this time, the thickness of the thin layer TL is about 6 to 7 microns.

On the other hand, the drive controller 514 controls the first, second and third drivers 521, 531 and 541 such that the rotational circumferential speed of the measuring roller 520 is 555 mm/s, that of the toner collecting roller 530 is 500 mm/s and that of the carrier liquid collecting roller 540 is 500 mm/s when the toner density sensor 512 detects the toner density to be a high density (e.g. 30%). This causes the thickness of the thin layer TL to be reduced to about 4 to 5 microns. As a result, even if the toner density increases under a condition where a voltage generated by the charger 550 is constant, the toner in the thin layer TL can be sufficiently charged.

(2) An Increase in the Rotational Circumferential Speed of the Measuring Roller

Figure 9B:
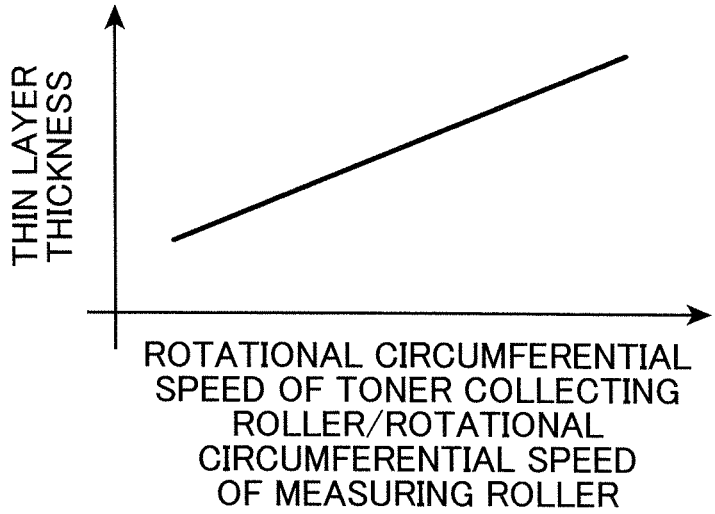

FIG. 9B is a graph showing a relationship between a ratio of the rotational speed of the toner collecting roller 530 to that of the measuring roller 520 and the thickness of the thin layer TL. When F1, F2 denote the rotational circumferential speed of the measuring roller 520 and that of the toner collecting roller 530, the thin layer TL becomes thinner as a value F2/F1 decreases as shown in the graph. This is because the amount of the liquid developer DL that can pass the first nip portion N1 decreases by increasing the rotational circumferential speed of the measuring roller 520 to relatively reduce the rotational circumferential speed of the toner collecting roller 530 with respect to that of the measuring roller 520.

The drive controller 514 controls the first, second and third drivers 521, 531 and 541 such that the rotational circumferential speed of the measuring roller 520 is 1330 mm/s, that of the toner collecting roller 530 is 1200 mm/s and that of the carrier liquid collecting roller 540 is 1200 mm/s as in the first embodiment when the toner density sensor 512 detects the toner density to be a normal density (e.g. 5%). In other words, the ratio of the rotational circumferential speed of the measuring roller 520 to that of the toner collecting roller 530 rotating in the opposite direction is set at about 1:0.9. Note that the nip depth of the first nip portion N1 is 0.1 mm. At this time, the thickness of the thin layer TL is about 6 to 7 microns.

On the other hand, the drive controller 514 controls the first, second and third drivers 521, 531 and 541 such that the rotational circumferential speed of the measuring roller 520 is increased to 1600 mm/s and those of the toner collecting roller 530 and the carrier liquid collecting roller 540 are maintained at 1200 mm/s when the toner density sensor 512 detects the toner density to be a high density (e.g. 30%). In other words, the ratio of the rotational circumferential speed of the measuring roller 520 to that of the toner collecting roller 530 is set at about 1:0.75. This causes the thickness of the thin layer TL to be reduced to about 4 to 5 microns. As a result, even if the toner density increases under a condition where a voltage generated by the charger 550 is constant, the toner in the thin layer TL can be sufficiently charged.

Fourth Embodiment

Figure 8:
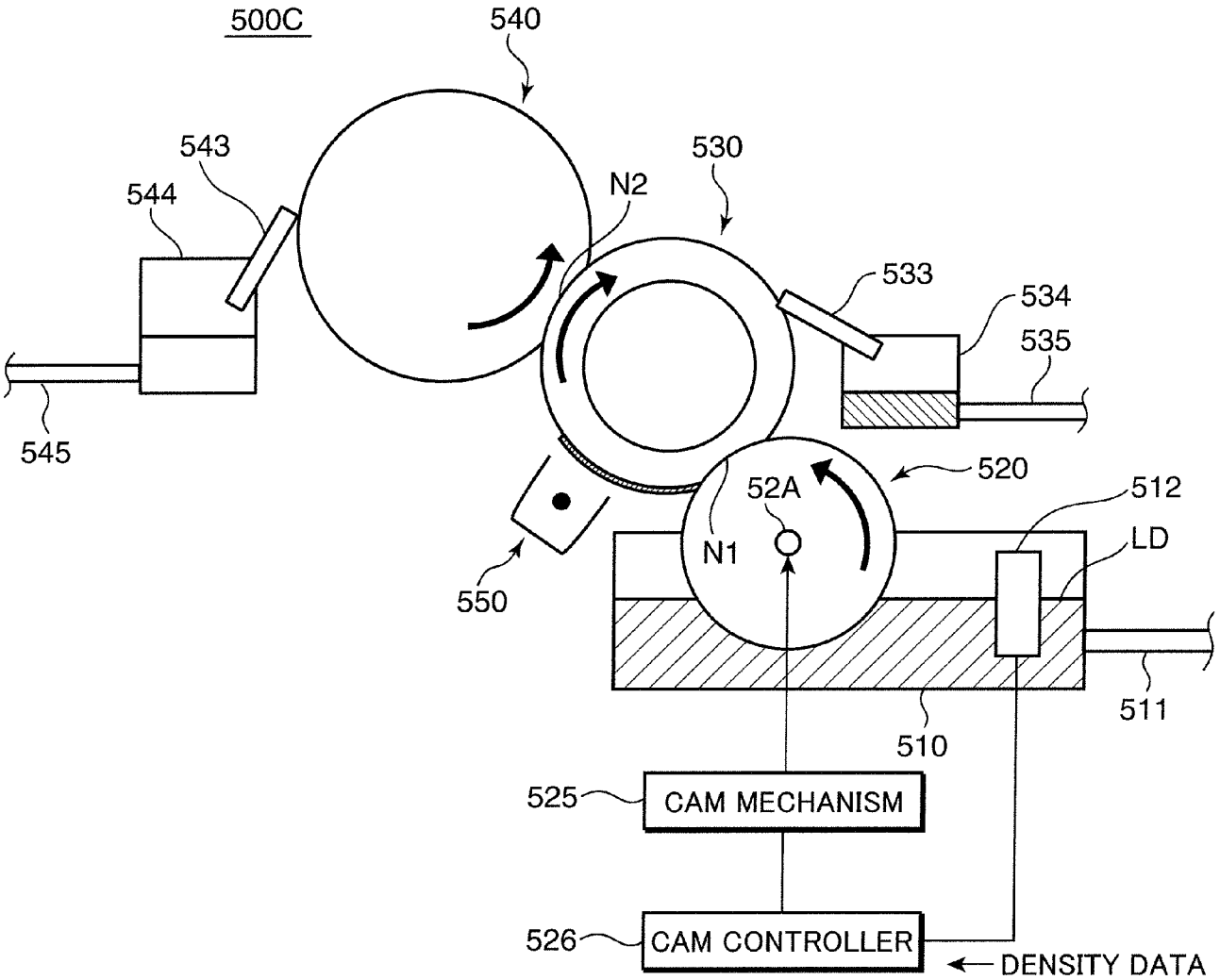
FIG. 8 is a diagram showing a construction of a carrier liquid extractor according to a fourth embodiment of the invention.

FIG. 8 is a diagram showing a construction of a carrier liquid extractor 500C according to a fourth embodiment. This carrier liquid extractor 500C actively adjusts the thickness of the thin layer TL according to the toner density as in the third embodiment, but differs from the third embodiment in adopting a construction of adjusting the nip depth of the first nip portion N1 as a thickness adjusting means. Other constructions are similar to the previous embodiments although some of them are not shown.

The carrier liquid extractor 500C includes a cam mechanism 525 (nip adjusting device) for adjusting the nip depth of the first nip portion N1 formed by the measuring roller 520 and the toner collecting roller 530, and a cam controller 526 for controlling an operation of this cam mechanism 525 based on the toner density detected by the toner density sensor 512. The cam mechanism 525 includes a cam member engageable with the rotary shaft 52A of the measuring roller 520 and adjusts a pressed degree of the measuring roller 520 against the toner collecting roller 530, i.e. the nip depth by the rotation of this cam member.

Figure 9C:
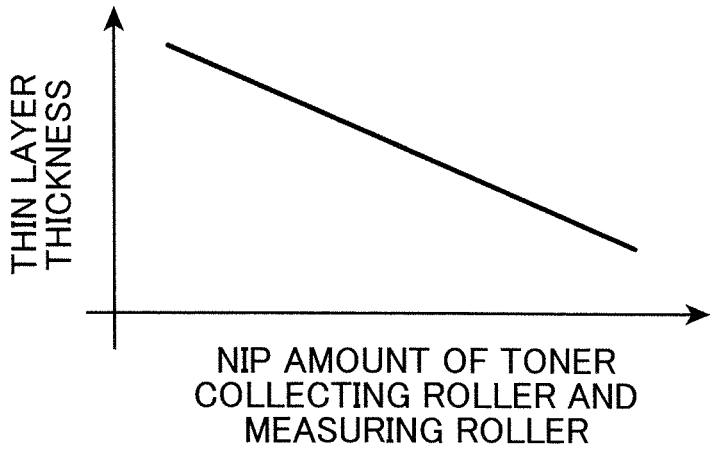

FIG. 9C is a graph showing a relationship between the nip depth of the first nip portion N1 and the thickness of the thin layer TL. As shown in the graph, the thin layer TL becomes thinner as the nip portion depth increases. This is because the amount of the liquid developer LD that can pass the first nip portion N1 decreases as the nip depth of the first nip portion N1 increases.

The cam controller 526 controls the cam mechanism 525 such that the nip depth of the first nip portion N1 is 0.1 mm as in the first embodiment when the toner density sensor 512 detects the toner density to be a normal density (e.g. 5%). Note that the rotational circumferential speed of the measuring roller 520 is 1330 mm/s, that of the toner collecting roller 530 is 1200 mm/s and that of the carrier liquid collecting roller 540 is 1200 mm/s. At this time, the thickness of the thin layer TL is about 6 to 7 microns.

On the other hand, the cam controller 526 controls the cam mechanism 525 such that the nip depth of the first nip portion N1 is 0.2 mm when the toner density sensor 512 detects the toner density to be a high density (e.g. 30%). Note that the rotational circumferential speeds of the respective rollers 520, 530 and 540 are maintained at the above values. This causes the thickness of the thin layer TL to be reduced to about 4 to 5 microns. As a result, even if the toner density increases under a condition where a voltage generated by the charger 550 is constant, the toner in the thin layer TL can be sufficiently charged.

Fifth Embodiment

Figure 10:
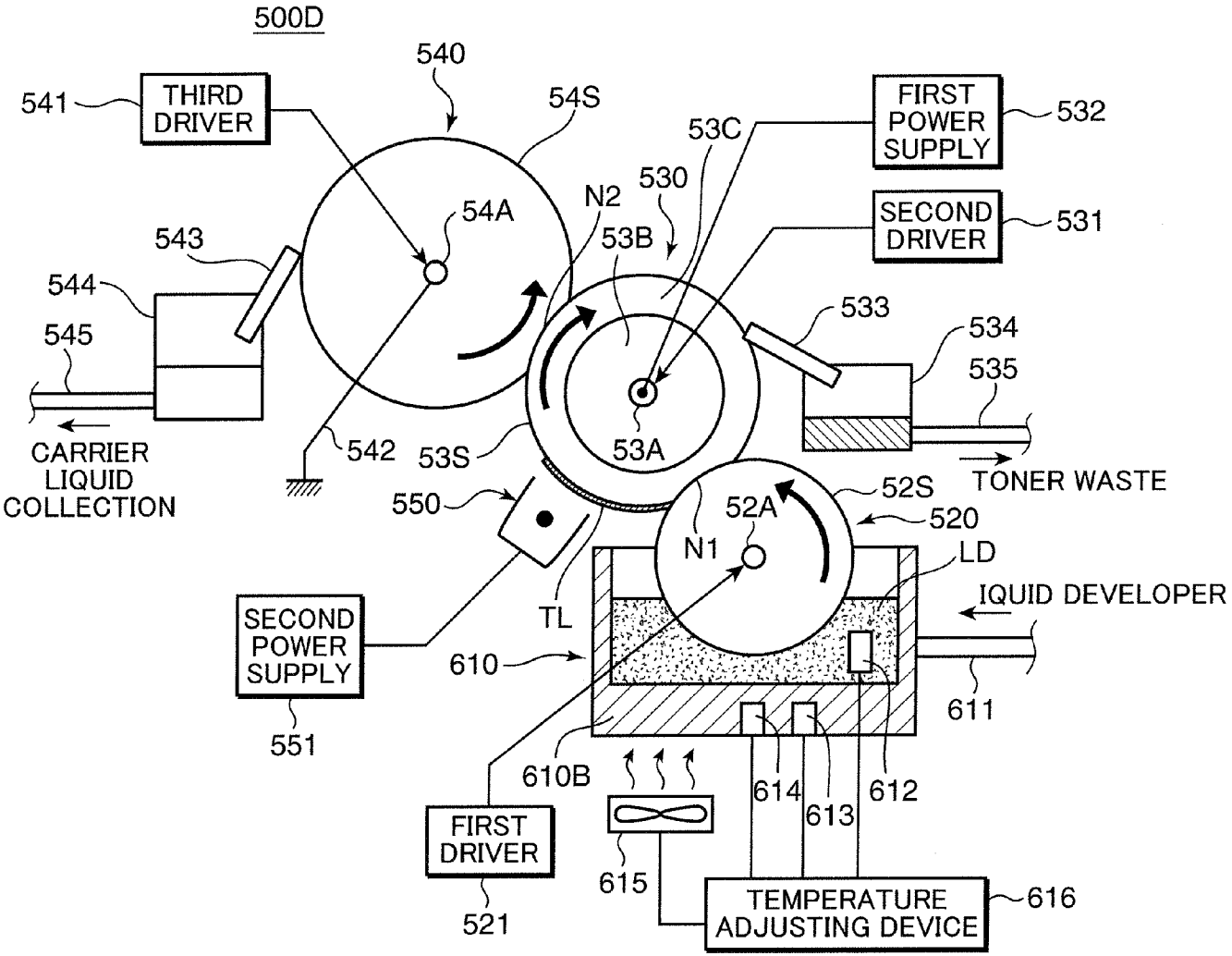
FIG. 10 is a diagram showing a construction of a carrier liquid extractor according to a fifth embodiment of the invention.

FIG. 10 is a diagram showing a construction of a carrier liquid extractor 500D according to a fifth embodiment. In FIG. 10, the same parts as in the carrier liquid extractor 500 of the first embodiment are denoted by the same reference numerals. Specifically, the carrier liquid extractor 500D is the same as the carrier liquid extractor 500 of the first embodiment in including a liquid tank 610, the measuring roller 520, the toner collecting roller 530, the carrier liquid collecting roller 540 and the charger 550 as a basic construction. Out of these, the liquid tank 610 and its surrounding construction differ from the above embodiments. In this fifth embodiment, there is illustrated the carrier liquid extractor 500D including a temperature adjusting device for adjusting temperature of a liquid developer LD stored in the liquid tank 610 according to a toner density in the liquid developer LD. A construction relating to the liquid tank 610 including the temperature adjusting device is described below without describing the same parts as in the previous embodiments.

The liquid tank 610 is a box with an open upper side and the liquid developer LD is stored in this tank. A developer supply pipe 611 is connected to the liquid tank 610, and the liquid developer LD collected in an image forming unit is successively supplied into the liquid tank 610 via the developer supply pipe 611 by driving an unillustrated pump. An agitating member for agitating the liquid developer LD is desirably provided in this liquid tank 610.

A container made of metal or resin with good thermal conductivity can be used as the liquid tank 610. Depending on the type of a heating device 613 to be described later, a container made of ceramic may be used. In this embodiment, a toner density sensor 612 (density detector), the heating device 613 (heating source), a temperature sensor 614, a cooling device 615 and a temperature adjusting device 616 are provided in such a liquid tank 610 as a temperature adjusting device for the stored liquid developer LD.

The toner density sensor 612 detects the toner density in the liquid developer LD stored in the liquid tank 610. The toner density sensor 612 is, for example, a light transmissive sensor utilizing a change in a light transmission amount depending on the density of toner particles in the liquid developer LD. The toner density sensor 612 is arranged in the liquid tank 610, and a sensor probe thereof is arranged at such a position as to be able to contact with the liquid developer LD. An output data of the toner density sensor 612 according to the density of the toner particles is given as a toner density data to the temperature adjusting device 616.

The heating device 613 heats the liquid developer LD in the liquid tank 610. A resistance heating device, a dielectric heating device, an induction heating device, a microwave heating device, a far-infrared heating device or the like can be used as this heating device 613. Out of these, the resistance heating device is preferably used due to its simple structure and easy control. An iron-chromium-aluminum heating element, a nickel-chromium heating element, a sheath heater using one of these heating elements or the like can be used as the resistance heating device. Such a resistance heating device is assembled, for example, by being mounted on an outer wall surface of the liquid tank 610, embedded in a wall surface or arranged in a cavity of the liquid tank 610.

The temperature sensor 614 directly detects the temperature of the liquid developer LD in the liquid tank 610 or indirectly measures the temperature of the liquid developer LD by measuring the temperature of the liquid tank 610. A temperature data detected by the temperature sensor 614 is fed to the temperature adjusting device 616. Various sensors can be employed as this temperature sensor 614. For example, a semiconductor resistance temperature sensor, a thermocouple, a platinum resistance temperature detector, an expansion type thermometer, a radiation thermometer or the like can be used as such. Out of these, a thermistor (semiconductor resistance temperature sensor) with advantages of having high accuracy and being inexpensive is desirably used.

The cooling device 615 cools the liquid developer LD in the liquid tank 610. A mechanical air-cooling device such as a blast fan, a gas cooling device, a phase change cooling device, a liquid cooling device, a Peltier element cooling device or the like can be used as this cooling device 615. Note that the cooling device 615 may be omitted and the liquid tank 610 (liquid developer LD) may be cooled by natural air cooling. In this case, it is desirable to provide a duct or the like forming a convectional air path near the liquid tank 610.

The temperature adjusting device 616 causes the heating device 613 or the cooling device 615 to operate according to the toner density data fed from the toner density sensor 612, thereby controlling the temperature of the liquid developer LD in the liquid tank 610. A control operation of the temperature adjusting device 616 is described in detail later.

As described above, the thickness of the thin layer TL formed on the circumferential surface 53S of the toner collecting roller 530 may change depending on the toner density of the liquid developer LD stored in the liquid tank 610. A change in the thickness of the thin layer TL may affect a charging characteristic of this thin layer TL and make it difficult to separate toner particles T and a carrier liquid C. In view of this point, the carrier liquid extractor 500D according to the fifth embodiment has a function of adjusting the temperature of the liquid developer LD stored in the liquid tank 610 according to the toner density using the temperature adjusting device 616, thereby consequently adjusting the thickness of the thin layer TL.

Figure 11:
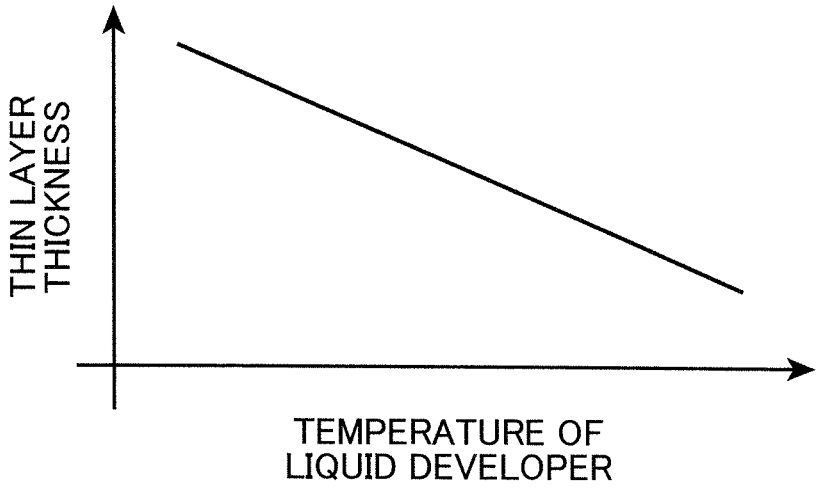
FIG. 11 is a graph showing a thickness control for a thin layer of a liquid developer formed on a toner collecting roller in the fifth embodiment.

FIG. 11 is a graph showing a relationship between the thickness of the thin layer TL formed on the toner collecting roller 530 and the temperature of the liquid developer LD. As shown in FIG. 11, a phenomenon in which the thin layer TL becomes thinner as the temperature of the liquid developer LD increases to reduce viscosity and, on the other hand, becomes thicker as the temperature of the liquid developer LD decreases to increase viscosity is utilized to adjust the thickness of the thin layer TL.

Specifically, the temperature adjusting device 616 causes the heating device 613 to set the temperature of the liquid developer LD to 35° C. (first temperature) when the toner density sensor 612 detects the toner density in the liquid developer LD to be a normal density (e.g. toner density is 5%; seventh density). This enables the thin layer TL to be formed on the circumferential surface 53S of the toner collecting roller 530 with a normal thickness (e.g. thickness of about 6 to 7 microns). On the other hand, the temperature adjusting device 616 causes the heating device 613 to operate to increase the temperature of the liquid developer LD to 50° C. (second temperature) when the toner density is detected to a higher density (e.g. toner density is 10%; eighth density) than the normal density by a predetermined value or more. This enables the thin layer TL to be formed on the circumferential surface 53S with a thickness (e.g. thickness of about 4 to 5 microns) thinner than the normal thickness by a predetermined value or more.

The temperature adjusting device 616 executes a temperature control with a determined target temperature as described above while referring to a temperature data measured by the temperature sensor 614. The temperature adjusting device 616 obtains a relationship between the toner density, at which satisfactory charging can be realized, and the thickness of the thin layer TL beforehand and includes an unillustrated memory for storing a table defining the relationship between the thickness of the thin layer TL and the temperature of the liquid developer LD. The above target temperature is read from the memory according to the toner density and the heating device 613 or the cooling device 615 is so driven that the temperature of the liquid developer LD approaches this target temperature.

As described above, the thickness of the thin layer TL is adjusted to become thinner as the toner density increases, with the result that the toner in the thin layer TL can be appropriately charged regardless of the toner density even if a charging voltage generated by the charger 550 is constant. According to an experiment conducted by the present inventors, it was confirmed that the toner in the thin layer TL could be charged in a preferable charging range of about +30 V to +50 V with the liquid developer LD having a toner density of 10% set at 50° C. when the above measuring roller 520 and toner collecting roller 530 were used, the nip depth of the first nip portion N1 was 0.1 mm, the measuring roller 520 and the toner collecting roller 530 were respectively rotated at 1330 mm/s and 1200 mm/s, and a positive potential of +4 kV was fed to the charging wire of the charger 550.

According to the carrier liquid extractor 500D of the fifth embodiment, even if the toner density in the liquid developer LD changes for a certain reason, the temperature of the liquid developer LD is adjusted according to the toner density by the temperature adjusting device 616, with the result that the thickness of the thin layer TL is adjusted to a value suitable for charging. Thus, the toner in the thin layer TL can be sufficiently charged even if the toner density increases under a condition where a voltage generated by the charger 550 is constant.

Sixth Embodiment

Figure 12:
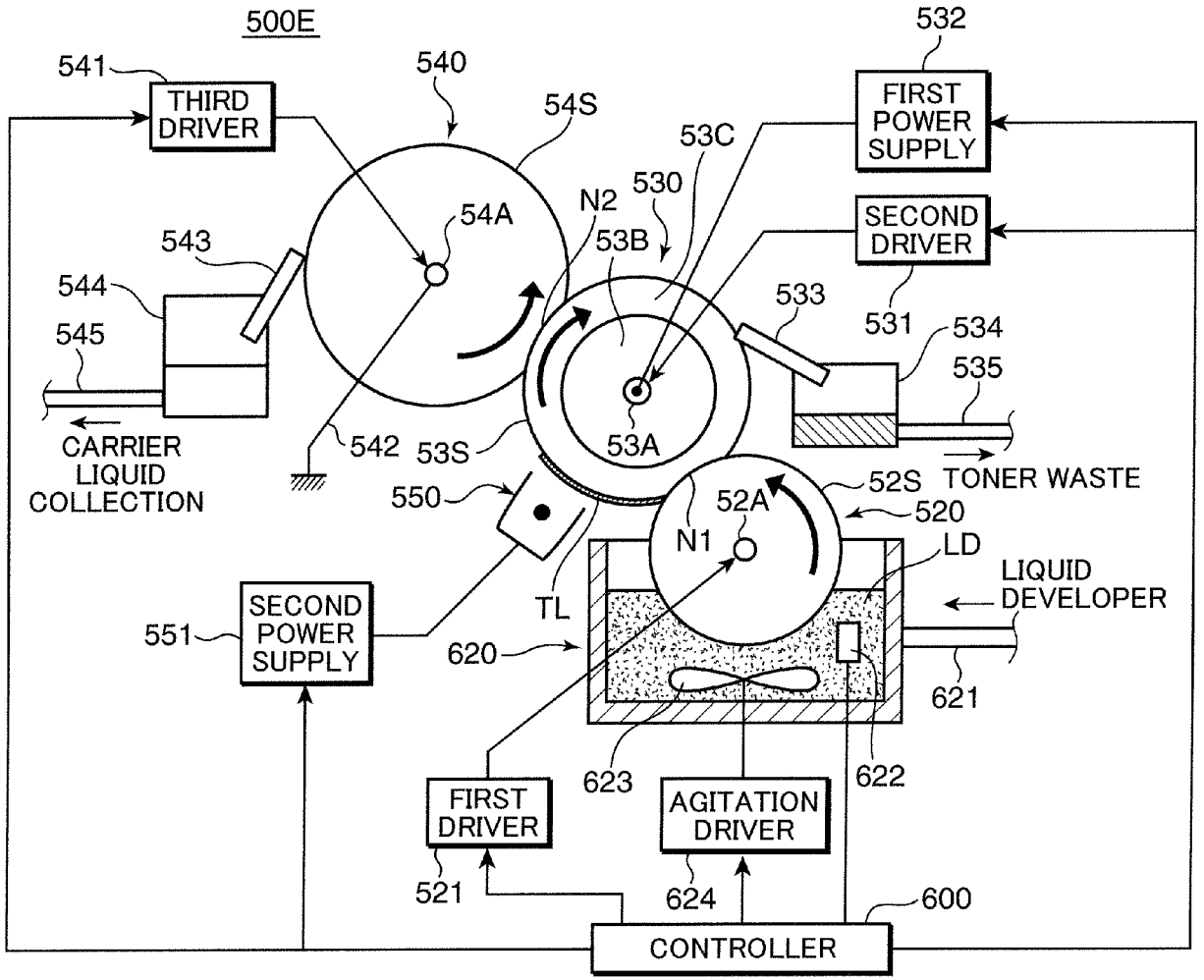
FIG. 12 is a diagram showing a construction of a carrier liquid extractor according to a sixth embodiment of the invention.

FIG. 12 is a diagram showing a construction of a carrier liquid extractor 500E according to a sixth embodiment. In FIG. 12, the same parts as in the carrier liquid extractor 500 of the first embodiment are denoted by the same reference numerals. Specifically, the carrier liquid extractor 500E is the same as the carrier liquid extractor 500 of the first embodiment in including a liquid tank 620, the measuring roller 520, the toner collecting roller 530, the carrier liquid collecting roller 540 and the charger 550 as a basic construction. Out of these, the liquid tank 620 and its surrounding construction differ from the above embodiments. The carrier liquid extractor 500E is a device whose operating condition is changed (changed between an operating state and a stopped state) according to a toner density of a liquid developer LD stored in the liquid tank 620. The liquid tank 620 and a construction relating to an operating condition control are described below without describing the same parts as in the previous embodiments.

The liquid tank 620 is a box with an open upper side and the liquid developer LD is stored in this tank. A developer supply pipe 621 is connected to the liquid tank 620, and the liquid developer LD collected in an image forming unit is successively and intermittently supplied into the liquid tank 620 via the developer supply pipe 621 by driving an unillustrated pump. A container made of metal or resin with good thermal conductivity or a container made of ceramic can be used as the liquid tank 620. A toner density sensor 622 (density detector), an agitating member 623 (agitating member) and an agitation driver 624 (drive controller) are provided in such a liquid tank 620.

The toner density sensor 622 detects the toner density in the liquid developer LD stored in the liquid tank 620. The toner density sensor 622 is, for example, a light transmissive sensor utilizing a change in a light transmission amount depending on the density of toner particles in the liquid developer LD. The toner density sensor 622 is arranged in the liquid tank 620, and a sensor probe thereof is arranged at such a position as to be able to contact with the liquid developer LD. For example, an arrangement of a light emitting element (emission peak wavelength: 940 nm) for generating near-infrared light and alight receiving element (reception peak wavelength: 1000 nm) for receiving near-infrared light at a specified distance from each other can be used as this sensor probe. An output data (output voltage) according to the density of the toner particles is given as a toner density data to a controller 600.

The agitating member 623 constantly agitates the liquid developer LD stored in the liquid tank 620 to maintain a state where the toner is uniformly dispersed in the carrier liquid. This agitating member 623 includes an agitating blade arranged in the liquid tank 620 and an agitating shaft for transmitting a rotational force to this agitating blade. Although one agitating member 623 is arranged in an example shown in FIG. 12, a plurality of agitating members may be arranged in the liquid tank 620.

The agitation driver 624 includes a motor and a gear coupled to an output shaft of this motor and generates a rotational force for driving and rotating the agitating member 623. The agitation driver 624 basically constantly rotates the agitating member 623. This enables the toner density sensor 622 to precisely detect the toner density. Although described in detail later, if the toner density in the liquid developer LD in the liquid tank 620 exceeds a predetermined value, the operation of the carrier liquid extractor 500E is stopped. Also during this stop period, the agitation driver 624 rotates the agitating member 623 to maintain the state where the toner is uniformly dispersed in the carrier liquid.

The controller 600 controls driving operations of the respective rollers 520, 530 and 540, a charging operation by the charger 550 and a bias application operation to the toner collecting roller 530 by controlling the operations of the first driver 521, the second driver 531, the third driver 541, the first power supply 532 and the second power supply 551. Particularly in this embodiment, the controller 600 sets the carrier liquid extractor 500E in the operating state or the stopped state by selecting the execution or stop of the above respective operation controls according to the toner density data fed from the toner density sensor 622.

As described above, the thickness of the thin layer TL formed on the circumferential surface 53S of the toner collecting roller 530 may change according to the toner density of the liquid developer LD stored in the liquid tank 610. A change in the thickness of the thin layer TL may affect a charging characteristic of this thin layer TL and make it difficult to separate the toner particles T and the carrier liquid C. As a countermeasure, the controller 600 causes the carrier liquid extractor 500E according to the sixth embodiment to stop operating when the toner density sensor 622 detects a high toner density exceeding the predetermined value during the operation (operating state) of the carrier liquid extractor 500E.

Specifically, the controller 600 sets the carrier liquid extractor 500E in the stopped state when the toner density in the liquid developer LD is a density at which it is difficult to set the thickness of the thin layer TL to a desired thickness, thereby temporarily stopping separation and extraction of the toner and the carrier liquid. When the toner density sensor 622 detects that the toner density is a proper value, the controller 600 restarts the operation of the carrier liquid extractor 500E. This can result in reliable separation of the toner and the carrier liquid even if the toner density in the liquid developer LD changes.

Figures 13, 14:
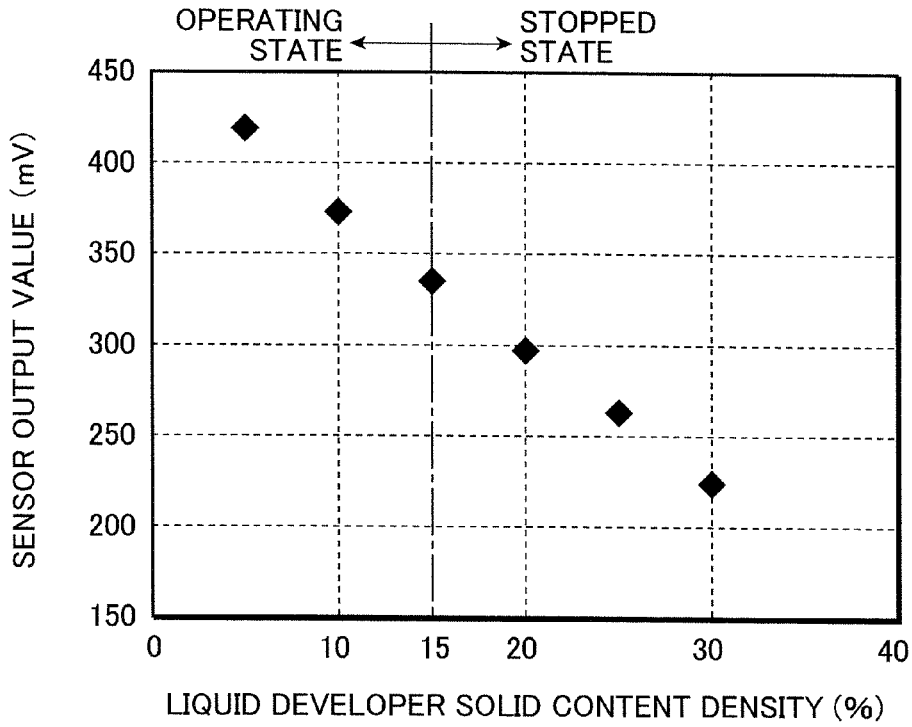
FIG. 13 is a graph showing a relationship between a toner density and an output of a toner density sensor.
FIG. 14 is a table showing an evaluation on carrier liquid extracted states.

FIG. 13 is a graph showing a relationship between the toner density in the liquid developer LD and an output of the toner density sensor 622. An output voltage of the toner density sensor 622 changes as shown in FIG. 13 according to the toner density. For example, in the case of setting the carrier liquid extractor 500E to stop operating when the toner density becomes 15%, the carrier liquid extractor 500E is set in the stopped state or the operating state depending on whether or not the output voltage of the toner density sensor 622 is in excess of 340 mV. The toner density for determining whether or not to operate the carrier liquid extractor 500E is determined also in consideration of a charging voltage for the thin layer TL and a bias voltage applied to the toner collecting roller 530.

FIG. 14 is a table showing an evaluation of carrier liquid extracted states. Here, to which degree the toner remains in the carrier liquid separated by the carrier liquid collecting roller 540 is evaluated using a charge bias supplied to the charging wire of the charger 550 and a roller bias applied to the toner collecting roller 530 as parameters when the toner density is 5% (normal time), a higher density of 15% and an even higher density of 30%. When the toner density in the carrier liquid is 0.1% or below, ○ is given assuming that the carrier liquid and the toner were satisfactorily separated and x is given when this condition was not satisfied.

Based on the result shown in FIG. 14, a state where compensation by the roller bias of the toner collecting roller 530 shows no effect is reached when the toner density is 15% if the charge bias of the charger 550 is assumed to be a constant value of 4 kV. Thus, the toner density for determining whether or not to operate the carrier liquid extractor 500E can be set at 15%.

In this case, the controller 600 activates the first driver 521, the second driver 531, the third driver 541, the first power supply 532 and the second power supply 551 in a state where the toner density sensor 622 detects that the toner density in the liquid developer LD is a normal density (e.g. toner density is 5%; ninth density), whereby the carrier liquid extractor 500E is set in the operating state with the respective rollers 520, 530 and 540 driven and rotated at 1330 mm/s, 1200 mm/s and 1200 mm/s, a charge bias of 4 kV generated by the charger 550 and a roller bias of −400 V applied to the rotary shaft 53A of the toner collecting roller 530 by the first power supply 532. In this way, the liquid developer LD collected into the liquid tank 620 is separated into the toner and the carrier liquid.

On the other hand, when the toner density is detected to be higher than the normal density by a predetermined value or more (e.g. toner density is 15%; tenth density), the controller 600 stops the active operations of the above respective parts and sets the carrier liquid extractor 500E in the stopped state. This can prevent the carrier liquid separating operation from being performed in a state where the thin layer TL having an improper thickness is formed on the circumferential surface 53S due to an increase in the viscosity of the liquid developer LD. Note that the controller 600 constantly sets the agitation driver 624 in an active state. Thus, the agitating member 623 agitates the liquid developer LD in the liquid tank 620 regardless of whether the carrier liquid extractor 500E is set in the stopped state or in the operating state.

The liquid developer LD collected in the image forming unit is intermittently supplied to the liquid tank 620 via the developer supply pipe 621. Accordingly, even if the toner density temporarily increases to about 15%, the toner density returns to a normal level if collection progresses to a certain degree since the toner density of the collected liquid developer LD is normally about 5%. Upon confirming a return of the toner density from a high density level to the normal level based on an output value of the toner density sensor 622, the controller 600 sets the carrier liquid extractor 500E in the operating state again.

To forcibly reduce the toner density of the liquid developer LD having a high toner density, a liquid developer LD having a low level of toner density may be intentionally supplied to the liquid tank 620. A method for forcing the image forming unit to form images close to blank images and collecting the liquid developer LD hardly containing any toner can be illustrated as a specific method.

According to the carrier liquid extractor 500E described above, if the toner density in the liquid developer LD increases to a high level for a certain reason, the operation of the carrier liquid extractor 500E is temporarily stopped to avoid the separating operation of the toner particles T and the carrier liquid C under a high toner density condition. As a result, the toner particles T and the carrier liquid C can be reliably separated.

[Embodiment as an Image Forming Apparatus]

Figure 15:
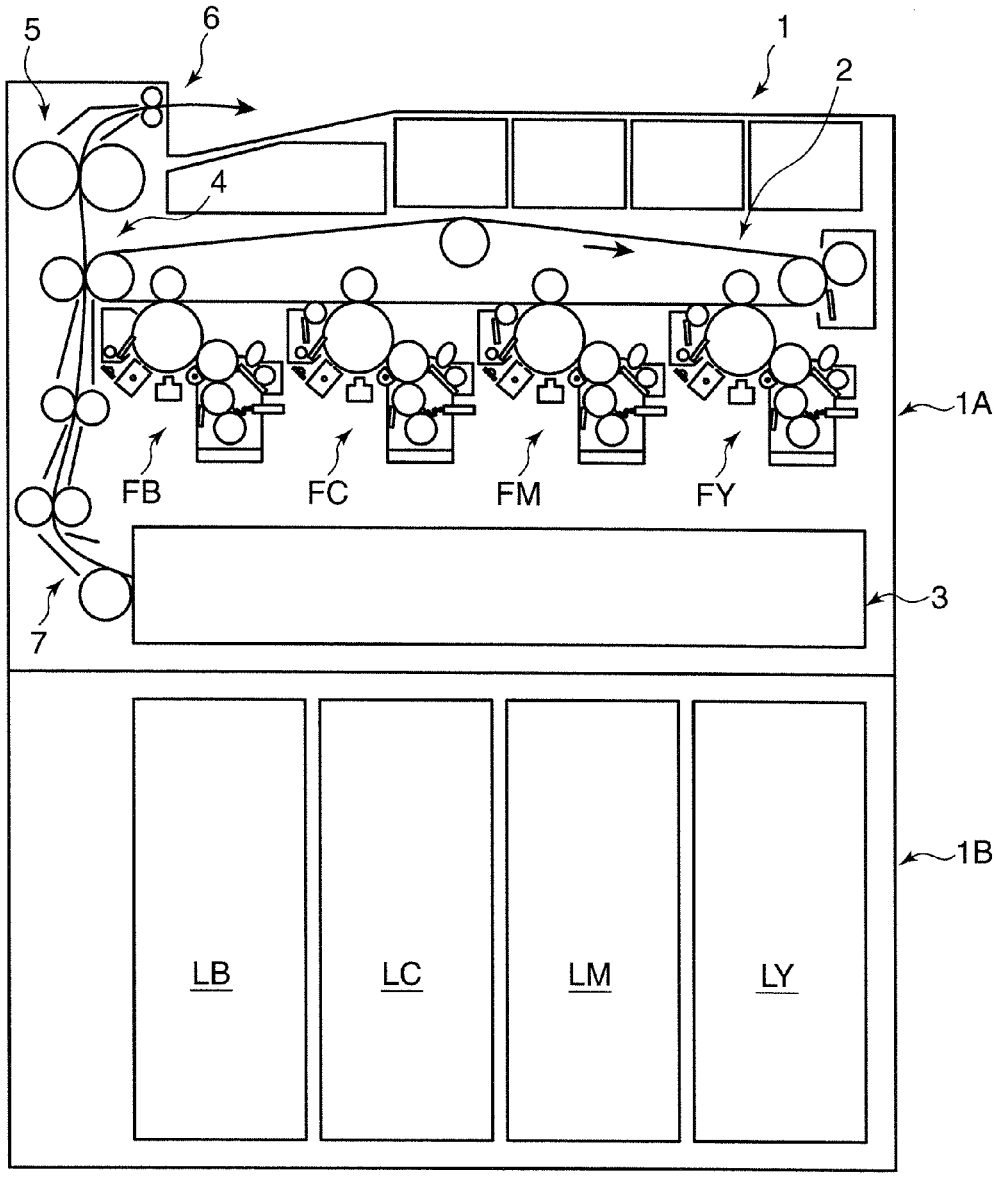
FIG. 15 is an entire schematic sectional view of a color printer according to one embodiment of the invention.
Figure 16:
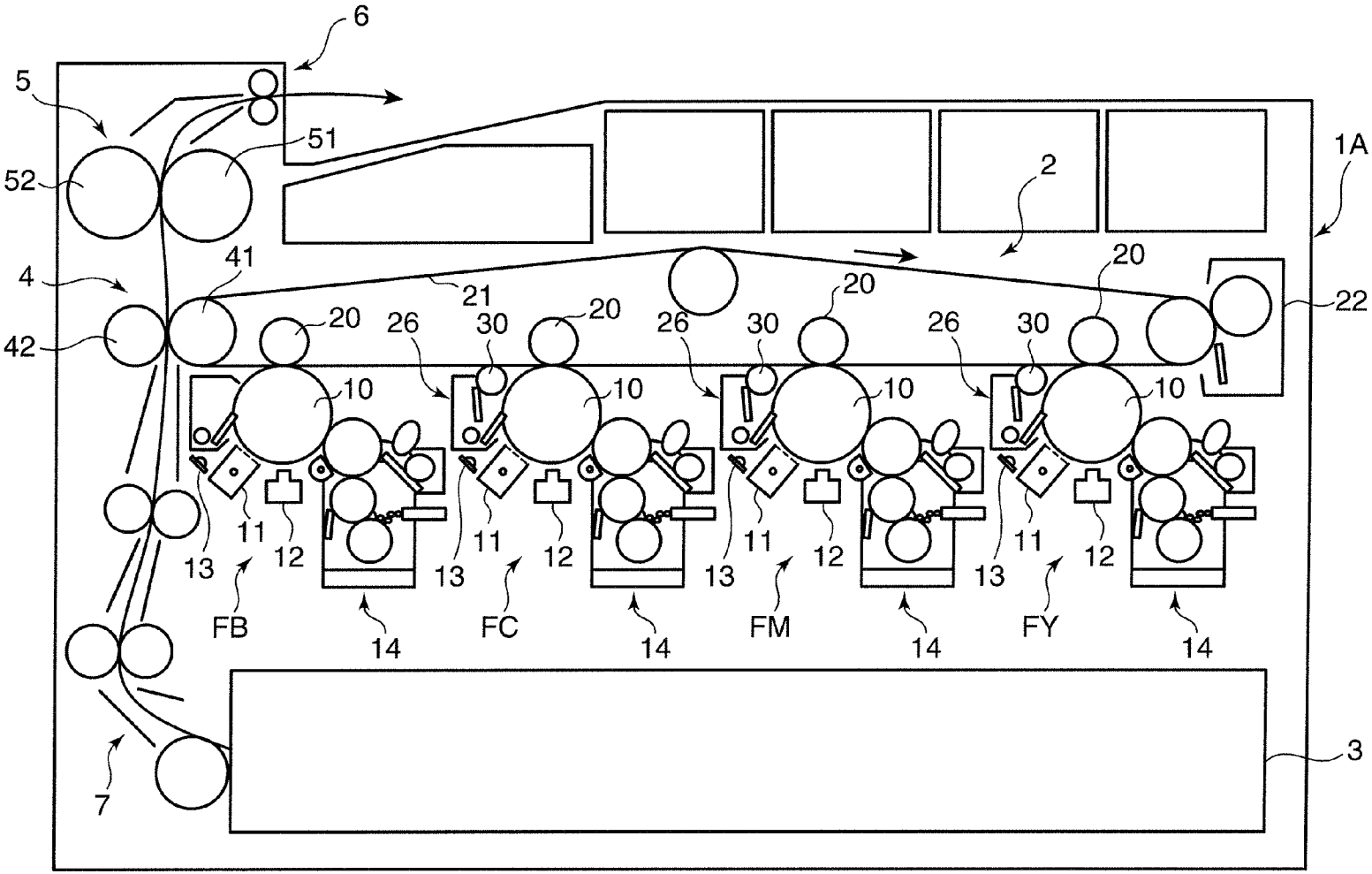
FIG. 16 is a schematic sectional view of the color printer except for liquid developer circulating devices.
Figure 17:
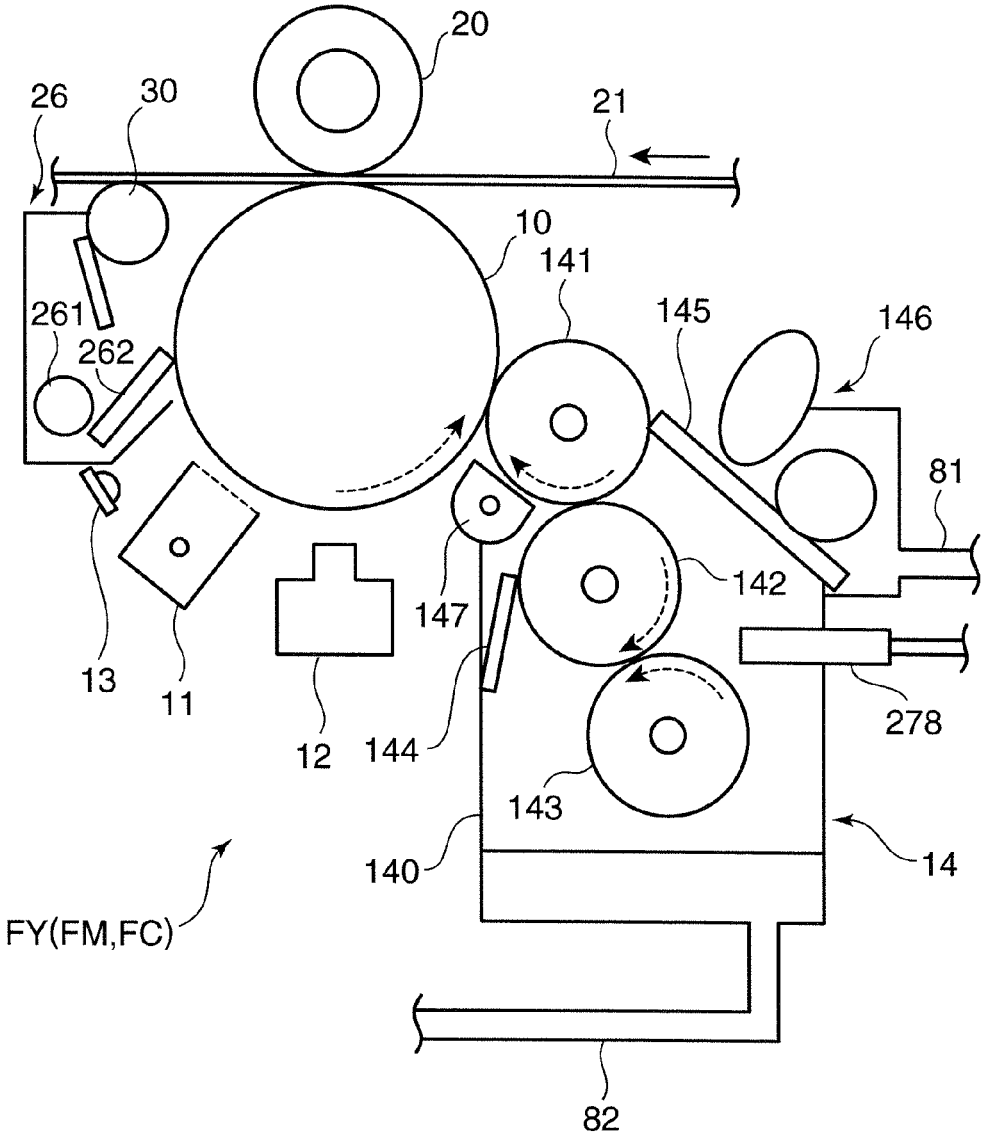
FIG. 17 is a sectional view enlargedly showing one image forming unit.

FIG. 15 is a schematic construction diagram of a color printer 1 (wet-type image forming apparatus) having any one of the carrier liquid extractors 500, 500A to 500E according to the above first to sixth embodiments incorporated therein, FIG. 16 is a schematic sectional view of the color printer 1 except liquid developer circulating devices, and FIG. 17 is a sectional view enlargedly showing one image forming unit. Although the image forming apparatus shown in FIGS. 15 to 17 is a color printer, it may be a copier, a facsimile machine, a complex machine (MFP) including these functions or another apparatus capable of forming an image on a sheet.

As shown in FIG. 15, the color printer 1 includes an upper main body 1A housing various units and parts for image formation and a lower main body 1B arranged below this upper main body 1A and housing liquid developer circulating devices LY, LM, LC and LB for respective colors. Here, pipes connecting the upper and lower main bodies 1A, 1B are not shown.

As shown in FIG. 16, the upper main body 1A includes a tandem image forming station 2 for forming a toner image based on an image data, a sheet storage unit 3 for storing sheets, a secondary transfer unit 4 for transferring the toner image formed by the image forming station 2 to a sheet, a fixing unit 5 for fixing the transferred toner image to the sheet, a sheet discharging unit 6 for discharging the sheet finished with a fixing process and a sheet conveying unit 7 for conveying the sheet from the sheet storage unit 3 to the sheet discharging unit 6.

The image forming station 2 includes an intermediate transfer belt 21, a cleaner 22 for the intermediate transfer belt 21 and image forming units FY, FM, FC and FB corresponding to respective colors of yellow (Y), magenta (M), cyan (C) and black (Bk).

The intermediate transfer belt 21 is an endless, i.e. looped belt-like member having a conductive property and a width larger than largest sheets in a direction orthogonal to a conveying direction of usable sheets, and is driven and rotated in a clockwise direction in FIGS. 15 and 16. A surface of the intermediate transfer belt 21 facing outward during rotation and an opposite surface thereof are respectively called an outer surface and an inner surface below.

The four image forming units FY, FM, FC and FB are arranged side by side near the intermediate transfer belt 21 and between the cleaner 22 for the intermediate transfer belt 21 and the secondary transfer unit 4. Note that an arrangement order of the respective image forming units FY, FM, FC and FB is not limited to this, but this arrangement is preferable in view of influence of mixing of the respective colors on a complete image.

Each of the image forming units FY, FM, FC and FB includes a photoconductive drum 10, a charger 11, an LED exposure device 12, a developing device 14, a primary transfer roller 20, a cleaner 26, a charge neutralizer 13 and a carrier liquid removing roller 30. Out of the image forming units, the image forming unit FB closest to the secondary transfer unit 4 does not include the carrier liquid removing roller 30, but the other construction thereof is identical.

The liquid developer circulating devices LY, LM, LC and LB are respectively provided in correspondence with the image forming units FY, FM, FC and FB to supply and collect the liquid developers of the respective colors. The liquid developer circulating devices LY, LM, LC and LB are described in detail later.

The photoconductive drum 10 is a cylindrical member and can carry a toner image containing a charged toner (positively charged in this embodiment) on its surface. The photoconductive drum 10 is a member rotatable counterclockwise in FIGS. 15 and 16. The charger 11 is a device capable of uniformly charging the surface of the photoconductive drum 10. The exposure device 12 includes a light source such as an LED and irradiates the uniformly charged surface of the photoconductive drum 10 with light based on an image data input from an external apparatus. In this way, an electrostatic latent image is formed on the surface of the photoconductive drum 10.

The developing device 14 causes a toner to adhere to the electrostatic latent image by holding a liquid developer (liquid sample) containing the toner (dispersoid) and a liquid carrier (dispersion medium) in such a manner as to face the electrostatic latent image on the surface of the photoconductive drum 10. In this way, the electrostatic latent image is developed into a toner image.

With reference to FIG. 17, the developing device 14 includes a developer container 140, a developing roller 141, a supply roller 142, a supporting roller 143, a supply roller blade 144, a developer cleaning blade 145, a developer collector 146 and a developing roller charger 147.

The developer container 140 is a container, into which the liquid developer containing toner particles and the liquid carrier is supplied. Although described later, this liquid developer is supplied into the developer container 140 through a supply nozzle 278 with densities of the toner and carrier adjusted beforehand. Note that the liquid developer is supplied toward a nip portion between the supply roller 142 and the supporting roller 143 and the extra liquid developer falls below the supporting roller 143 and stored in a bottom part of the developer container 140. The stored liquid developer is collected via a pipe 82 by the liquid developer circulating device (see FIG. 18).

The supporting roller 143 is arranged substantially in the center of the developer container 140 and held in contact with the supply roller 142 from below to form the nip portion. The supply roller 142 is arranged not right above the supporting roller 143, but obliquely upward in a direction away from the supply nozzle 278, and grooves for holding the liquid developer are formed in a circumferential surface thereof. As shown by dotted arrows in FIG. 17, the supporting roller 143 rotates counterclockwise and the supply roller 142 rotates clockwise.

The liquid developer supplied from the supply nozzle 278 is temporarily accumulated at a side upstream of the nip portion with respect to rotating directions of the rollers 142, 143 and conveyed upwardly while being held in the grooves of the supply roller 142 as the two rollers 142, 143 rotate. The supply roller blade 144 is pressed into contact with the circumferential surface of the supply roller 142 so as to restrict an amount of the liquid developer held on the supply roller 142 to a predetermined amount. The extra liquid developer scraped off by the supply roller blade 144 is received at the bottom part of the developer container 140.

The developing roller 141 is arranged in contact with the supply roller 142 at an upper opening of the developer container 140. The developing roller 141 is rotated in the same direction as the supply roller 142 (the circumferential surface of the developing roller 141 moves in a direction opposite to the circumferential surface of the supply roller 142 in a nip portion where the developing roller 141 and the supply roller 142 are in contact), whereby the liquid developer held on the circumferential surface of the supply roller 142 is transferred to the circumferential surface of the developing roller 141. Since a thickness of a layer of the liquid developer on the supply roller 142 is restricted to the predetermined value, that of a layer of the liquid developer formed on the circumferential surface of the developing roller 141 is also maintained at a predetermined value.

The developing roller charger 147 gives a charging potential having the same polarity as a charge characteristic of the toner, thereby improving development efficiency by causing the toner in the liquid developer carried on the developing roller 141 to move to the circumferential surface of the developing roller 141. The developing roller charger 147 is disposed to face the circumferential surface of the developing roller 141 at a side downstream of a contact portion with the supply roller 142 and upstream of a contact portion with the photoconductive drum 10 with respect to a rotating direction of the developing roller 141.

The developing roller 141 is in contact with the photoconductive drum 10. A toner image corresponding to an image data instructed to form an image is formed on the circumferential surface of the photoconductive drum 10 due to a difference between a potential of an electrostatic latent image on the circumferential surface of the photoconductive drum 10 and that of a developing bias applied to the developing roller 141.

The developer cleaning blade 145 is arranged in contact with the developing roller 141 at a side downstream of the contact portion with the photoconductive drum 10 in the rotating direction of the developing roller 141, and removes the liquid developer on the circumferential surface of the developing roller 141 finished with a developing operation for the photoconductive drum 10.

The developer collector 146 collects the liquid developer removed by the developer cleaning blade 145 and feeds it to a pipe 81 of the liquid developer circulating device. The liquid developer flows down along a surface of the developer cleaning blade 145. Since the viscosity of the liquid developer is high, the developer collector 146 includes a feed roller which assists the feed of the liquid developer.

The primary transfer roller 20 is arranged at the inner surface of the intermediate transfer belt 21 to face the photoconductive drum 10. A voltage having a polarity (negative polarity in this embodiment) opposite to the toner in the toner image is applied to the primary transfer roller 20 from an unillustrated power supply. In other words, the primary transfer roller 20 applies a voltage having a polarity opposite to the toner to the intermediate transfer belt 21 at a position in contact with the intermediate transfer belt 21. Since the intermediate transfer belt 21 has a conductive property, the toner is attracted to the outer side of the intermediate transfer belt 21 and its surrounding by this voltage application. The intermediate transfer belt 21 functions as an image bearing member for bearing a toner image and conveying it to a sheet.

The cleaner 26 is a device for cleaning the liquid developer remaining without being transferred to the intermediate transfer belt 21 from the photoconductive drum 10 and includes a remaining developer conveying screw 261 and a cleaning blade 262. The remaining developer conveying screw 261 is a member for conveying the remaining developer scraped off by the cleaning blade 262 and stored in the cleaner 26 to the outside of the cleaner 26, and arranged in the cleaner 26.

The cleaning blade 262 is a plate-like member extending in a direction of a rotary shaft of the photoconductive drum 10 and adapted to scrape off the liquid developer remaining on the circumferential surface of the photoconductive drum 10. The cleaning blade 262 has an end portion thereof held in sliding contact with the circumferential surface of the photoconductive drum 10 to scrape off the liquid developer remaining on the photoconductive drum 10 as the photoconductive drum 10 rotates.

The charge neutralizer 13 includes a light source for charge neutralization and electrically neutralizes the circumferential surface of the photoconductive drum 10 by light from the light source in preparation for image formation by a next rotation after the liquid developer is removed by the cleaning blade 262.

The carrier liquid removing roller 30 is a substantially cylindrical member rotatable in the same direction as the photoconductive drum 10 about a rotary shaft parallel with the rotary shaft of the photoconductive drum 10. The carrier liquid removing roller 30 is arranged closer to the secondary transfer unit 4 than a contact position of the photoconductive drum 10 and the intermediate transfer belt 21 and removes the carrier liquid from the outer surface of the intermediate transfer belt 21.

Referring back to FIG. 16, the sheet storage unit 3 is for storing sheets to have toner images fixed thereto and arranged in a lower part of the upper main body 1A. The sheet storage unit 3 includes a sheet cassette storing the sheets.

The secondary transfer unit 4 is for transferring a toner image formed on the intermediate transfer belt 21 to a sheet and includes a supporting roller 41 supporting the intermediate transfer belt 21 and a secondary transfer roller 42 arranged to face the supporting roller 41.

The fixing unit 5 is for fixing a toner image to a sheet and arranged above the secondary transfer unit 4. The fixing unit 5 includes a heating roller 51 and a pressure roller 52 arranged to face the heating roller 51.

The sheet discharging unit 6 is for discharging a sheet having a toner image fixed thereto in the fixing unit 5 and arranged in an upper part of the color printer 1. The sheet conveying unit 7 includes a plurality of conveyor roller pairs and conveys a sheet from the sheet storage unit 3 to the secondary transfer unit 4, the fixing unit 5 and the sheet discharging unit 6.

Figure 18:
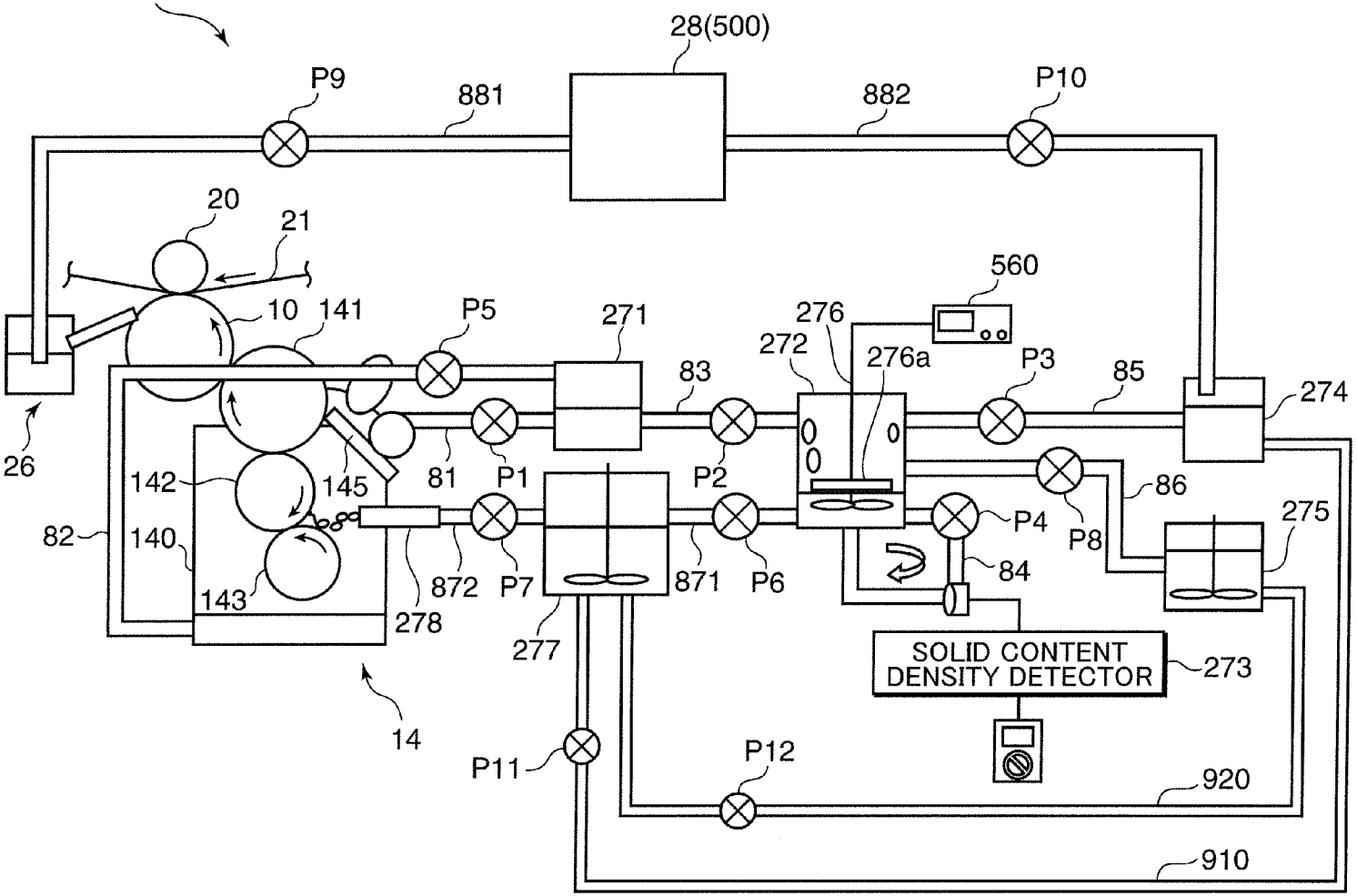
FIG. 18 is a construction diagram of the liquid developer circulating device.

FIG. 18 is a schematic block diagram showing one entire liquid developer circulating device LY. The other liquid developer circulating devices LM, LC and LB are also identically constructed. This liquid developer circulating device LY is a device for circulating and reutilizing the remaining developer (mixture of the toner and the carrier liquid) scraped off from the circumferential surface of the developing roller 141 by the developer cleaning blade 145 after the liquid developer is supplied to the photoconductive drum 10.

The liquid developer circulating device LY includes a remaining developer tank 271, a developer storage container 272, a solid content density detector 273, a carrier tank 274, a toner tank 275, an agitator 276, a developer reserve tank 277, a liquid developer supplier 278, a liquid developer separator 28 (extractor), a plurality of pumps P1 to P12 and a controller 560. Here, any one of the carrier liquid extractors 500, 500A to 500E according to the above first to sixth embodiments is employed as the liquid developer separator 28.

The remaining developer tank 271 is a tank connected to the developing device 14 via a first pipe 81 and a second pipe 82 and capable of storing the liquid developer collected from the developing device 14. The first pump P1 and the fifth pump P5 are respectively mounted at intermediate positions of the first and second pipes 81, 82.

The liquid developer scraped off from the circumferential surface of the developing roller 141 by the developer cleaning blade 145 after the supply of the toner to the photoconductive drum 10 is fed to the remaining developer tank 271 via the first pipe 81 by driving the first pump P1. The liquid developer stored in the developer container 140 without being supplied to the developing roller 141 from the supply roller 142 in the developer container 140 is fed to the remaining developer tank 271 via the second pipe 82 by driving the fifth pump P5.

The developer storage container 272 is connected to the remaining developer tank 271. The developer storage container 272 is a container for adjusting the toner density to a proper range, especially, adjusting a toner density of the remaining developer to a proper range by adding a developer having a higher toner density than the developer used in the developing device 14 or the carrier liquid to the remaining developer. This liquid developer having the toner density adjusted is supplied to the developing device 14. The developer storage container 272 is connected to the remaining developer tank 271 via a third pipe 83, in which the second pump P2 is mounted. The liquid developer in the remaining developer tank 271 is fed to the developer storage container 272 via the third pipe 83 by driving the second pump P2.

The solid content density detector 273 is a device for detecting a density of the toner of the liquid developer in the developer storage container 272. The solid content density detector 273 is connected to an annular fourth pipe 84 connected to the developer storage container 272. The fourth pump P4 is mounted in this annular fourth pipe 84. The liquid developer in the developer storage container 272 is introduced from an entrance end of the fourth pipe 84 to the solid content density detector 273 by driving the fourth pump P4 and, thereafter, returned to the developer storage container 272 from an exit end of the fourth pipe 84.

The carrier tank 274 is a tank for storing the carrier liquid. When the density of the toner is determined to be higher than the proper range by the solid content density detector 273, the carrier liquid is supplied into the developer storage container 272 from the carrier tank 274 to reduce the toner density of the liquid developer in the container 272. The carrier tank 274 and the developer storage container 272 are connected by a fifth pipe 85, and the carrier liquid is supplied by driving the third pump P3 provided at an intermediate position of the fifth pipe 85.

The toner tank 275 is a tank for storing the liquid developer having a higher toner density than the liquid developer used in the developing device 14. When the density of the toner is determined to be lower than the proper range by the solid content density detector 273, the liquid developer having a higher toner density is supplied into the developer storage container 272 from the toner tank 275 to increase the toner density of the liquid developer in the container 272. The toner tank 275 and the developer storage container 272 are connected by a sixth pipe 86, and the liquid developer is supplied by driving the eighth pump P8 provided at an intermediate position of the sixth pipe 86.

The agitator 276 is a member for agitating the liquid developer in the developer storage container 272. A purpose of this agitation is to uniformly mix the toner or carrier liquid introduced into the developer storage container 272 for density adjustment with the existing liquid developer in the developer storage container 272 and re-disperse the toner, which might cohere in the liquid developer stored in the developer storage container 272. The agitator 276 includes a rotary shaft and agitating blades attached to the leading end of this rotary shaft. A liquid level detecting member 276*a* is coaxially mounted on the rotary shaft. This liquid level detecting member 276*a* is driven by an unillustrated motor and an amount of the liquid developer is detected based on a load change of the motor resulting from the contact of the liquid level detecting member 276*a* with the liquid level of the liquid developer.

The developer reserve tank 277 is a tank for storing the liquid developer to be supplied to the developing device 14. The developer reserve tank 277 is connected to the developer storage container 272 via a seventh pipe 871 and has the liquid developer supplied from the developer storage container 272 by driving the sixth pump P6 disposed at an intermediate position of the seventh pipe 871. Further, the developer reserve tank 277 is connected to the carrier tank 274 via a first direct conduit 910 and to the toner tank 275 via a second direct conduit 920. The eleventh and twelfth pumps P11, P12 are respectively disposed in the first and second direct conduits 910, 920, and the carrier and the toner can be directly supplied into the developer reserve tank 277 from the respective tanks. Carrier and toner supply systems via these first and second direct conduits 910, 920 are utilized in the case of quickly producing a liquid developer according to a known blending ratio such as at the time of starting the use of the color printer 1 in which no collected liquid developer is produced yet.

The supply nozzle 278 is a member for supplying the liquid developer stored in the developer reserve tank 277 to the developing device 14 (developer container 140). The supply nozzle 278 and the developer reserve tank 277 are connected by an eighth pipe 872, and the liquid developer is supplied by driving the seventh pump P7 disposed in the eighth pipe 872.

The liquid developer circulating device LY further includes the direct conduit 910 extending from the carrier tank 274 to the developer reserve tank 277 and the direct conduit 920 extending from the toner tank 275 to the developer reserve tank 277. These direct conduits 910, 920 are used to supply predetermined amounts of the carrier and the toner to the developer reserve tank 277 before circulation is carried out. This enables a developing process to quickly start.

Although not shown, a liquid level detector for detecting a liquid level in the tank is disposed at a suitable position of each of the remaining developer tank 271, the carrier tank 274, the toner tank 275 and the developer reserve tank 277.

The liquid developer separator 28 is a device for separating the toner and the carrier liquid from the remaining developer collected by the cleaner 26 and separately extracting the toner and the carrier liquid. The cleaner 26 and the liquid developer separator 28 are connected by a ninth pipe 881 in which the ninth pump P9 is disposed. The remaining developer in the cleaner 26 is fed to the liquid developer separator 28 by driving the ninth pump P9. Further, a tenth pipe 882, in which the tenth pump P10 is disposed, is provided between the liquid developer separator 28 and the carrier tank 274. The carrier liquid extracted by the liquid developer separator 28 is fed to the carrier tank 274 by driving the tenth pump P10. Here, the developer supply pipe 511 and the carrier liquid collecting conduit 545 in FIGS. 1, 5, 7 and 8 respectively correspond to the ninth pipe 881 and the tenth pipe 882.

The controller 560 includes a CPU (Central Processing Unit) for performing arithmetic processings, a ROM (Read Only Memory) storing respective control programs and the like, a RAM (Random Access Memory) for temporarily storing data obtained by arithmetic processings and control processings, etc. The controller 560 controls the drive of the first to twelfth pumps P1 to P12, the drive of the motor for operating the liquid level detecting member 276*a*, etc.

Next, the operation of the color printer 1 is described. The color printer 1 having received an image forming instruction from a personal computer (not shown) connected thereto forms toner images of the respective colors corresponding to an image data instructed to form an image using the image forming units FY, FM, FC and FB. Specifically, electrostatic latent images based on the image data are formed on the photoconductive drums 10, and the toners are supplied to these electrostatic latent images from the developing devices 14. The images formed in the respective image forming units FY, FM, FC and FB in this way are transferred to the intermediate transfer belt 21 and superimposed on the intermediate transfer belt 21 to form a color toner image.

In synchronism with the formation of this color toner image, a sheet stored in the sheet storage unit 3 is dispensed one by one by an unillustrated sheet feeder and conveyed along the sheet conveying unit 7. The sheet is fed to the secondary transfer unit 4 while being timed with primary transfers to the intermediate transfer belt 21 and the color toner image on the intermediate transfer belt 21 is secondarily transferred to the sheet in the secondary transfer unit 4.

The sheet having the color toner image transferred thereto is further conveyed to the fixing unit 5 and has the color toner image fixed thereto by heat and pressure. The sheet is further discharged to the outside of the color printer 1 by the sheet discharging unit 6. After the secondary transfer, the toners remaining on the intermediate transfer belt 21 are removed from the intermediate transfer belt 21 by the cleaner 22 for the intermediate transfer belt 21.

The liquid developers remaining on the developing rollers 141 without being supplied to the photoconductive drums 10 at the time of an image forming operation are scraped off by the developer collecting blades 145 and collected into the remaining developer tanks 271 via the first pipes 81. The liquid developers collected in the developer containers 140 without being supplied from the supply rollers 142 to the developing rollers 141 are also collected into the remaining developer tanks 271 via the second pipes 82. Further, the carrier liquids extracted from the remaining developers collected by the cleaners 26 by the liquid developer separators 28 are collected into the carrier tanks 274. The controller 560 controls the drive of the first, fifth, ninth and tenth pumps P1, P5, P9 and P10 to carry out the above liquid circulation.

When the amount of the liquid developer in the developer storage container 272 becomes zero, the controller 560 drives the second pump P2 to supply the remaining developer from the remaining developer tank 271 to the developer storage container 272. When the developer storage container 272 is filled with the remaining developer, the toner density of the liquid developer is detected by the solid content density detector 273. According to this detection result, the controller 560 drives the third pump P3 or the eighth pump P8 to supply a necessary amount of the carrier liquid or high-density liquid developer to the developer storage container 272. Thereafter, the toner density of the liquid developer is detected again by the solid content density detector 273. If the toner density is in the proper range, the liquid developer is supplied to the developer reserve tank 277 according to need.

In the liquid developer separator 28, the carrier liquid and the toner particles are separated by the operation described in the previous first to sixth embodiments. Specifically, the collected liquid developer is introduced into the liquid tank 510 via the ninth pipe 881 (developer supply pipe 511, 611 or 621). The carrier liquid separated by the carrier liquid collecting roller 540 is fed to the carrier tank 274 via the tenth pipe 882 (carrier liquid collecting conduit 545). On the other hand, the toner collected from the toner collecting roller 530 is introduced to the waste tank. According to the color printer 1 including such liquid developer separators 28, the toner and the carrier liquid can be separated at a higher speed, wherefore a high-speed printing process can be coped with.

The embodiments of the present invention are described above. The present invention is not limited to these and may be modified, for example, as follows.

(1) In the above embodiments is illustrated the example in which the liquid sample to be processed is the liquid developer, the dispersoid is the toner and the dispersion medium is the carrier liquid. The present invention is not limited to this and can be widely applied provided that a liquid sample contains a dispersoid and a dispersion medium and the dispersoid can be charged. For example, a liquid sample may contain a pigment as a dispersoid and moisture as a dispersion medium.

(2) In the above embodiments, the carrier liquid collecting roller 540 is illustrated as the separating member. A blade member whose tip is held in contact with the circumferential surface 53S of the toner collecting roller 530 may be used as the separating member instead of such a roller member.

(3) In the above embodiments is illustrated the example in which the liquid developer LD drawn up by the measuring roller 520 is caused to pass the first nip portion N1 as a means for forming the thin layer TL. Instead, a restricting blade member whose tip is facing and at a predetermined distance (distance corresponding to the thickness of the thin layer TL) from the circumferential surface 53S of the toner collecting roller 530 may be used as a thin layer forming member.

The specific embodiments described above mainly include inventions having the following constructions.

An extractor according to one aspect of the present invention is for separating and extracting a dispersoid and a dispersion medium from a liquid sample containing the dispersoid and the dispersion medium and includes a first roller which carries a thin layer of the liquid developer containing the dispersoid and the dispersion medium on a circumferential surface thereof and rotates about a shaft; a separating member held in contact with the first roller and adapted to separate the dispersion medium from the thin layer carried on the first roller; a charger for charging the dispersoid in the thin layer carried on the first roller at a position upstream of a contact position of the separating member with the first roller with respect to a rotating direction of the first roller; and an electric field generator for generating an electric field for causing the charged dispersoid to be attracted to the circumferential surface of the first roller.

According to this construction, the thin layer of the liquid sample is carried on the circumferential surface of the first roller and the dispersoid in this thin layer is charged and electrically attracted to the circumferential surface of the first roller. Thus, the dispersoid can be eccentrically located on the circumferential surface of the first roller in the thin layer and the dispersion medium can be easily separated by the separating member.

In the above construction, the separating member is preferably a second roller which carries the dispersion medium on a circumferential surface thereof and rotates about a shaft. According to this construction, a nip portion can be formed by the first and second rollers and, when the thin layer passes the nip portion, the dispersion medium can be collected by the second roller while the dispersoid can be kept attracted to the circumferential surface of the first roller.

In the above construction, it is preferable to further include a liquid tank for storing the liquid developer and a thin layer forming member for forming the thin layer of the liquid sample on the circumferential surface of the first roller using the liquid sample in the liquid tank. According to this construction, it is possible to collect, for example, the used liquid developer into the liquid tank and form the thin layer using the liquid sample in the liquid tank. Thus, it is possible to provide a construction useful in the case of using the extractor for a recycling purpose.

In this case, it is preferable that the thin layer forming member is a third roller which is so arranged that a circumferential surface thereof is in contact with the liquid sample in the liquid tank, rotates about a shaft and conveys the liquid sample along the circumferential surface thereof; that the third roller is held in contact with the first roller to form a nip portion at a position upstream of an arranged position of the charger with respect to the rotating direction of the first roller; and that the liquid sample conveyed on the circumferential surface of the third roller passes the nip, thereby forming the thin layer on the circumferential surface of the first roller.

According to this construction, the liquid sample in the liquid tank is drawn up by the third roller and the liquid sample on the circumferential surface of the third roller is transferred to the first roller at the nip portion. By passing the nip portion, the transferred liquid sample is carried as the thin layer on the circumferential surface of the first roller. Therefore, the thin layer can be easily and stably formed.

Here, the third roller may be an anilox roller including recesses in its circumferential surface and a measuring member for restricting an amount of the liquid sample held on the circumferential surface of the anilox roller may be provided. According to this construction, the amount of the liquid sample drawn up from the liquid tank can be accurately controlled.

In the above construction, it is preferable that a first driving device for driving and rotating the first roller and the third roller about the respective shafts thereof is further provided; and that the first driving device rotates the first and third rollers in opposite directions such that a rotational circumferential speed of the third roller is faster than that of the first roller.

According to this construction, thickness non-uniformity of the thin layer carried on the circumferential surface of the first roller can be reduced. This can prevent charging non-uniformity as much as possible when the dispersoid is charged by the charger. Thus, the dispersoid can be reliably attracted to the circumferential surface of the first roller and a separation performance can be improved.

In the above construction, the electric field generator may be a power supply for applying a negative electric field to the first roller and the charger may positively charge the dispersoid in the thin layer. According to this construction, a construction for causing the dispersoid to be electrically attracted to the circumferential surface of the first roller can be simply achieved.

In the above construction, it is preferable that a density detector for detecting a density of the dispersoid in the liquid sample and a first charge adjusting device for adjusting a charge amount of the dispersoid in the thin layer are further provided; and that the first charge adjusting device causes the dispersoid to be charged with a first charge amount when the density detector detects the density of the dispersoid to be a first density while causing the dispersoid to be charged with a second charge amount different from the first charge amount when the density detector detects the density of the dispersoid to be a second density higher than the first density by a predetermined value or more.

According to this construction, the charge amount of the dispersoid is changed to the second charge amount different from the first charge amount when the density of the dispersoid in the liquid sample increases from the first density to the second density for a certain reason. This enables the dispersoid to be charged with an optimal charge amount corresponding to the density of the dispersoid and the dispersion medium and the dispersoid can be satisfactorily separated even when the density of the dispersoid is high.

Alternatively, in the above construction, it is preferable that a density estimator for acquiring information relating to the density of the dispersoid in the liquid sample and estimating the density of the dispersoid and a second charge adjusting device for adjusting the charge amount of the dispersoid in the thin layer are further provided; and that the second charge adjusting device causes the dispersoid to be charged with a third charge amount when the density estimator estimates the density of the dispersoid to be a third density while causing the dispersoid to be charged with a fourth charge amount different from the third charge amount when the density estimator estimates the density of the dispersoid to be a fourth density higher than the third density by a predetermined value or more.

According to this construction, the charge amount of the dispersoid can be controlled according to the density of the dispersoid estimated by the density estimator. Specifically, the charge amount of the dispersoid is changed to the fourth charge amount different from the third charge amount when the density of the dispersoid in the liquid sample is estimated to increase from the third density to the fourth density. Since this enables the dispersoid to be charged with an optimal charge amount corresponding to the density of the dispersoid, the dispersion medium and the dispersoid can be satisfactorily separated even when the density of the dispersoid is high. Note that a case where a toner on a toner image bearing member is collected without being transferred can be illustrated as a case where the density of the dispersoid in the liquid sample becomes high in the case of a wet-type image forming apparatus.

In this case, the first and second charge adjusting devices may control a voltage applied to the charger according to the first and second charge amounts or the third and fourth charge amounts. According to this construction, the charge amount of the dispersoid can be easily adjusted.

In the above construction, it is preferable that a density detector for detecting a density of the dispersoid in the liquid sample and a thickness adjusting device for adjusting a thickness of the thin layer on the first roller are further provided; and that the thickness adjusting device causes the thin layer having a first thickness to be formed on the first roller when the density detector detects the density of the dispersoid to be a fifth density while causing the thin layer having a second thickness smaller than the first thickness by a predetermined value or more to be formed on the first roller when the density detector detects the density of the dispersoid to be a sixth density higher than the fifth density by a predetermined value or more.

According to this construction, the thickness of the thin layer formed on the first roller is reduced from the first thickness to the second thickness when the density of the dispersoid in the liquid sample increases from the fifth density to the sixth density for a certain reason. Thus, even if the density of the dispersoid becomes higher in the liquid sample, it can be ensured that the dispersoid is stably electrically attracted to the first roller without particularly increasing the charge amount of the dispersoid. Therefore, the dispersion medium and the dispersoid can be satisfactorily separated.

Here, when the second roller and the third roller are respectively used as the separating member and the thin layer forming member, the thickness adjusting device may be a second driving device for driving and rotating the first, second and third rollers about the respective shafts thereof, and the second driving device may rotate the respective first, second and third rollers at predetermined first circumferential speeds when the fifth density is detected while rotating the first, second and third rollers at second circumferential speeds slower than the first circumferential speeds when the sixth density is detected.

According to this construction, when the density of the dispersoid in the liquid sample increases from the fifth density to the sixth density, the rotational circumferential speeds of all of the first, second and third rollers are reduced from the first circumferential speeds to the second circumferential speeds. Since the thickness of the thin layer, which can pass the nip portion between the first and third rollers, naturally becomes thinner, the thickness of the thin layer carried on the first roller can be adjusted.

When the third roller is used as the thin layer forming member, the thickness adjusting device may be a third driving device for driving and rotating the first and third rollers about the respective shafts thereof, and the third driving device may rotate the first and third rollers such that a ratio of a rotational circumferential speed of the third roller to that of the first roller is a predetermined first speed ratio when the fifth density is detected while rotating the first and third rollers at a second speed ratio at which the speed of the third roller is increased more than at the first speed ratio when the sixth density is detected.

According to this construction, when the density of the dispersoid in the liquid sample increases from the fifth density to the sixth density, the rotational circumferential speed of the third roller is increased relative to that of the first roller. By an increase in the speed of the third roller, the amount of the liquid sample transferred to the first roller is reduced, wherefore the thickness of the thin layer carried on the first roller can be adjusted.

When the third roller is used as the thin layer forming member, the thickness adjusting device may be a nip adjusting device for adjusting a nip depth of the first and third rollers, and the nip adjusting device may set the nip depth of the first and third rollers at a predetermined first depth when the fifth density is detected while setting the nip depth of the first and third rollers at a second depth larger than the first depth by a predetermined value when the sixth density is detected.

According to this construction, the nip depth of the first and third rollers is increased from the first depth to the second depth when the density of the dispersoid in the liquid sample increases from the fifth density to the sixth density. By an increase in the nip depth, the thickness of the thin layer that can pass the nip portion between the first and third rollers naturally becomes smaller, wherefore the thickness of the thin layer carried on the first roller can be adjusted.

In the above construction, it is preferable to further include a density detector for detecting a density of the dispersoid in the liquid sample and a temperature adjusting device for adjusting a temperature of the liquid sample in the liquid tank according to the density of the dispersoid. According to this construction, the density of the dispersoid in the liquid sample is detected by the density detector and the temperature of the liquid sample is adjusted according to the density of the dispersoid by the temperature adjusting device to adjust a viscosity of the liquid sample. Thus, even if the density of the dispersoid in the liquid sample changes, a formed state of the thin layer can be maintained at a desired state and the dispersoid and the dispersion medium can be reliably separated.

In the above construction, the temperature adjusting device preferably sets the temperature of the liquid sample in the liquid tank at a first temperature when the density detector detects the density of the dispersoid to be a seventh density while setting the temperature of the liquid sample in the liquid tank at a second temperature higher than the first temperature when the density detector detects the density of the dispersoid to be an eighth density higher than the seventh density by a predetermined value or more.

According to this construction, the temperature of the liquid sample in the liquid tank is changed to the second temperature higher than the first temperature when the density of the dispersoid in the liquid sample increases from the seventh density to the eighth density for a certain reason. Since this makes it possible to adjust the temperature of the liquid sample according to the density of the dispersoid and maintain the thickness of the liquid tank constant, the dispersion medium and the dispersoid can be satisfactorily separated even when the density of the dispersoid is high.

The temperature adjusting device preferably includes a temperature sensor for detecting the temperature of the liquid sample in the liquid tank and a heating source for heating the liquid sample in the liquid tank. According to this construction, the temperature adjusting device can be simply constructed by a feedback control and the like using the heating source and the temperature sensor.

In the above construction, it is preferable to further include a density detector for detecting a density of the dispersoid in the liquid sample; and a controller for setting the extractor in an operating state or a stopped state by controlling the drive of at least the thin layer forming member and the first roller according to a detection result on the density of the dispersoid by the density detector.

According to this construction, the density of the dispersoid in the liquid sample is detected by the density detector and the extractor is set in the operating state or the stopped state by the controller according to the detection result. Thus, when the density of the dispersoid is such a density at which it is difficult to set the thickness of the thin layer at a desired thickness, the extractor can be set in the stopped state and the separation and extraction of the dispersoid and the dispersion medium can be temporarily stopped. Therefore, even if the density of the dispersoid in the liquid sample changes, the dispersoid and the dispersion medium can be reliably separated.

In the above construction, the controller preferably sets the extractor in the operating state when the density detector detects the density of the dispersoid to be a ninth density while setting the extractor in the stopped state when the density detector detects the density of the dispersoid to be a tenth density higher than the ninth density by a predetermined value or more.

According to this construction, the extractor is set in the stopped state when the density of the dispersoid in the liquid sample increases from the ninth density to the tenth density for a certain reason. This prevents the formed thin layer from becoming too thick due to an increase in the density of the dispersoid. In other words, the operation of the extractor is prevented in a condition where it is difficult to reliably separate the dispersion medium and the dispersoid when the dispersoid has a high density, with the result that the dispersoid and the dispersion medium can be reliably separated.

In the above construction, it is preferable to include an agitating member for agitating the liquid sample in the liquid tank. According to this construction, precipitation and the like of the dispersoid can be suppressed and a state in which the dispersoid is uniformly dispersed in the dispersion medium can be maintained.

In this case, it is preferable that a conduit for intermittently supplying the liquid sample to the liquid tank and a drive controller for controlling the drive of the agitating member are further provided; and that the drive controller actuates the agitating member regardless of whether the controller sets the extractor in the operating state or in the stopped state.

According to this construction, the liquid sample is intermittently supplied to the liquid tank. Thus, even if, for example, the density of the dispersoid temporarily increases, a liquid sample having a lower density of the dispersoid may be supplied to the liquid tank through the conduit thereafter. Here, since the agitating member constantly operates to agitate the liquid sample, the state where the dispersoid is uniformly dispersed in the dispersion medium can be maintained also during a stopped period of the extractor. Therefore, the density detector can precisely detect the density and, consequently, an operation start timing of the extractor can be precisely determined.

In the above construction, it is preferable that the liquid sample is a liquid developer; that the dispersoid is a toner; and that the dispersion medium is a carrier liquid. According to this construction, the extractor of the present invention can be applied to a wet-type image forming apparatus.

A wet-type image forming apparatus according to another aspect of the present invention includes an image forming unit for forming an image using a liquid developer containing a toner and a carrier liquid; and an extractor for separating and extracting the toner and the carrier liquid from the liquid developer. This extractor has the construction of the above extractor.

An image forming apparatus according to still another aspect of the present invention includes a photoconductive drum for bearing a toner image on a circumferential surface thereof; a developing unit for supplying a liquid developer containing a toner and a carrier liquid to the photoconductive drum; a developer producing unit for producing a liquid developer having a blending ratio of the toner and the carrier liquid adjusted; a first supply system for supplying a developer having a higher toner density than the one used in the developing unit to the developer producing unit; a second supply system for supplying the carrier liquid to the developer producing unit; a third supply system for supplying the liquid developer produced in the developer producing unit to the developing unit via a reserve tank; a collection system for collecting the liquid developer supplied to the developing unit, but not consumed by the developing unit or the photoconductive drum and supplying it to the developer producing unit; and an extractor provided in the collection system for separating and extracting the toner and the carrier liquid from the collected liquid developer. This extractor has the construction of the above extractor.

According to the present invention, it is possible to provide an extractor which can separate a dispersoid and a dispersion medium at a high speed since a thin layer of a liquid developer is formed on the circumferential surface of the first roller and the dispersoid in the thin layer is electrically attracted to the circumferential surface of the first roller. Further, an image forming apparatus employing this extractor can cope with a high-speed printing process.

This application is based on Japanese Patent application serial Nos 2009-248082, 2009-248083 and 2009-248084 filed in Japan Patent Office on Oct. 28, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An extractor for separating and extracting a dispersoid and a dispersion medium from a liquid sample containing the dispersoid and the dispersion medium, comprising:

a first roller that carries a thin layer of the liquid developer containing the dispersoid and the dispersion medium on a circumferential surface thereof and rotates about a shaft;

a thickness adjusting device for adjusting a thickness of the thin layer on the first roller;

a separating member held in contact with the first roller and adapted to separate the dispersion medium from the thin layer carried on the first roller;

a charger for charging the dispersoid in the thin layer carried on the first roller at a position upstream of a contact position of the separating member with the first roller with respect to a rotating direction of the first roller;

an electric field generator for generating an electric field for causing the charged dispersoid to be attracted to the circumferential surface of the first roller;

a density detector for detecting a density of the dispersoid in the liquid sample;

a liquid tank for storing the liquid sample; and a thin layer forming member for forming the thin layer of the liquid sample on the circumferential surface of the first roller using the liquid sample in the liquid tank, wherein:

the thickness adjusting device causes the thin layer having a first thickness to be formed on the first roller when the density detector detects the density of the dispersoid to be a first density while causing the thin layer having a second thickness smaller than the first thickness by a predetermined value or more to be formed on the first roller when the density detector detects the density of the dispersoid to be a second density higher than the first density by a predetermined value or more, the thin layer forming member is a second roller that is so arranged that a circumferential surface thereof is in contact with the liquid sample in the liquid tank, rotates about a shaft and conveys the liquid sample along the circumferential surface thereof;

the thickness adjusting device is a nip adjusting device for adjusting a nip depth of the first and second rollers; and the nip adjusting device sets the nip depth of the first and second rollers at a predetermined first depth when the first density is detected while setting the nip depth of the first and second rollers at a second depth larger than the first depth by a predetermined value when the second density is detected.

2. An extractor for separating and extracting a dispersoid and a dispersion medium from a liquid sample containing the dispersoid and the dispersion medium, comprising:

a first roller which carries a thin layer of the liquid sample containing the dispersoid and the dispersion medium on a circumferential surface thereof and rotates about a shaft;

a separating member held in contact with the first roller and adapted to separate the dispersion medium from the thin layer carried on the first roller;

a charger for charging the dispersoid in the thin layer carried on the first roller at a position upstream of a contact position of the separating member with the first roller with respect to a rotating direction of the first roller;

an electric field generator for generating an electric field for causing the charged dispersoid to be attracted to the circumferential surface of the first roller;

a liquid tank for storing the liquid sample;

a thin layer forming member for forming the thin layer of the liquid sample on the circumferential surface of the first roller using the liquid sample in the liquid tank;

a density detector for detecting a density of the dispersoid in the liquid sample; and a temperature adjusting device for adjusting a temperature of the liquid sample in the liquid tank according to the density of the dispersoid.

3. An extractor according to claim 2, wherein the temperature adjusting device sets the temperature of the liquid sample in the liquid tank at a first temperature when the density detector detects the density of the dispersoid to be a first density while setting the temperature of the liquid sample in the liquid tank at a second temperature higher than the first temperature when the density detector detects the density of the dispersoid to be an second density higher than the first density by a predetermined value or more.

4. An extractor according to claim 2, wherein the temperature adjusting device includes a temperature sensor for detecting the temperature of the liquid sample in the liquid tank and a heating source for heating the liquid sample in the liquid tank.

5. An extractor for separating and extracting a dispersoid and a dispersion medium from a liquid sample containing the dispersoid and the dispersion medium, comprising:

a first roller which carries a thin layer of the liquid sample containing the dispersoid and the dispersion medium on a circumferential surface thereof and rotates about a shaft;

a separating member held in contact with the first roller and adapted to separate the dispersion medium from the thin layer carried on the first roller;

a charger for charging the dispersoid in the thin layer carried on the first roller at a position upstream of a contact position of the separating member with the first roller with respect to a rotating direction of the first roller;

an electric field generator for generating an electric field for causing the charged dispersoid to be attracted to the circumferential surface of the first roller;

a liquid tank for storing the liquid sample;

a thin layer forming member for forming the thin layer of the liquid sample on the circumferential surface of the first roller using the liquid sample in the liquid tank;

a density detector for detecting a density of the dispersoid in the liquid sample; and a controller for setting the extractor in an operating state or a stopped state by controlling the drive of at least the thin layer forming member and the first roller according to a detection result on the density of the dispersoid by the density detector.

6. An extractor according to claim 5, wherein the controller sets the extractor in the operating state when the density detector detects the density of the dispersoid to be a first density while setting the extractor in the stopped state when the density detector detects the density of the dispersoid to be a second density higher than the first density by a predetermined value or more.

7. An extractor according to claim 5, further comprising an agitating member for agitating the liquid sample in the liquid tank.

8. An extractor according to claim 7, further comprising:

a conduit for intermittently supplying the liquid sample to the liquid tank; and a drive controller for controlling the drive of the agitating member;

wherein the drive controller actuates the agitating member regardless of whether the controller sets the extractor in the operating state or in the stopped state.

9. An extractor according to claim 2, wherein:

the liquid sample is a liquid developer;

the dispersoid is a toner; and the dispersion medium is a carrier liquid.

10. A wet-type image forming apparatus, comprising:

an image forming unit for forming an image using a liquid developer containing a toner and a carrier liquid; and an extractor according to claim 2 for separating and extracting the toner as the dispersoid and the carrier liquid as the dispersion medium from the liquid developer.

11. An image forming apparatus, comprising:

a photoconductive drum for bearing a toner image on a circumferential surface thereof;

a developing unit for supplying a liquid developer containing a toner and a carrier liquid to the photoconductive drum;

a developer producing unit for producing a liquid developer having a blending ratio of the toner and the carrier liquid adjusted;

a first supply system for supplying a developer having a higher toner density than the one used in the developing unit to the developer producing unit;

a second supply system for supplying the carrier liquid to the developer producing unit;

a third supply system for supplying the liquid developer produced in the developer producing unit to the developing unit via a reserve tank;

a collection system for collecting the liquid developer supplied to the developing unit, but not consumed by the developing unit or the photoconductive drum and supplying it to the developer producing unit; and an extractor according to claim 2 provided in the collection system for separating and extracting the toner as the dispersoid and the carrier liquid as the dispersion medium from the collected liquid developer.

* * * * *